US010442513B2

(12) United States Patent
Bartholin

(10) Patent No.: US 10,442,513 B2
(45) Date of Patent: Oct. 15, 2019

(54) SPINNAKER LAUNCHING AND/OR RECOVERING SYSTEM AND METHOD AND A SAILBOAT COMPRISING THE SPINNAKER LAUNCHING AND/OR RECOVERING SYSTEM

(71) Applicant: Ejendomsselskabet AF 16. Januar 2015 ApS, Rungsted Kyst (DK)

(72) Inventor: Henrik Bartholin, Rungsted Kyst (DK)

(73) Assignee: EJENDOMSSELSKABET AF 16. JANUAR 2015 APS, Rungsted Kyst (DK)

( * ) Notice: Subject to any disclaimer, the term of this patent is extended or adjusted under 35 U.S.C. 154(b) by 0 days.

(21) Appl. No.: 15/563,733

(22) PCT Filed: Mar. 30, 2016

(86) PCT No.: PCT/DK2016/050093

§ 371 (c)(1),
(2) Date: Oct. 2, 2017

(87) PCT Pub. No.: WO2016/155747

PCT Pub. Date: Oct. 6, 2016

(65) Prior Publication Data

US 2018/0093747 A1 Apr. 5, 2018

(30) Foreign Application Priority Data

Mar. 30, 2015 (DK) ..... 2015 70183
Mar. 22, 2016 (WO) ..... PCT/DK2016/050086

(51) Int. Cl.
*B63H 9/08* (2006.01)
*B63H 9/10* (2006.01)
(Continued)

(52) U.S. Cl.
CPC ..... *B63H 9/1071* (2013.01); *B63B 21/08* (2013.01); *B63B 21/10* (2013.01); *B63H 9/1092* (2013.01)

(58) Field of Classification Search
CPC ..... B63H 9/1071; B63H 2009/0664
See application file for complete search history.

(56) References Cited

U.S. PATENT DOCUMENTS 3,310,018 A 3/1967 Roberts, Jr. et al.
4,022,144 A 5/1977 Gitchel
(Continued)

FOREIGN PATENT DOCUMENTS

BE 1014872 A7 5/2004
DE 2 157 240 A1 5/1973
(Continued)

*Primary Examiner* — Andrew Polay
(74) *Attorney, Agent, or Firm* — David S. Safran; Roberts Mlotkowski Safran Cole & Calderon, P.C.

(57) ABSTRACT

A method and a spinnaker launching and/or recovering system releasably attachable to the deck or integrated on the deck or into the hull of the sailboat for launching and/or recovering a spinnaker. The spinnaker setting and/or recovering system has a first spinnaker guide member, which is attachable, e.g., to the bow, a bowsprit or is built into the deck near the bow with an opening through which the tack line and/or a retrieval line attached to the clew corner or to the lower luff of an asymmetric spinnaker or retrieval lines attached to the tack corner and the clew corner or to the lower luff of a symmetric spinnaker. Running with the asymmetric spinnaker, tack corner may be taken forward by a second tack line operated from the cockpit. The first and second spinnaker guide members may be connected by a sleeve, e.g., made of textile, or a solid material.

18 Claims, 20 Drawing Sheets

(51) Int. Cl.
*B63B 21/08* (2006.01)
*B63B 21/10* (2006.01)

(56) References Cited

U.S. PATENT DOCUMENTS

| | | | | |
|---|---|---|---|---|
| 5,937,779 | A | 8/1999 | Murnikov | |
| 9,110,044 | B2 | 8/2015 | Gumbrecht et al. | |
| 9,120,545 | B2 * | 9/2015 | Kruger | B63H 9/1021 |
| 2014/0352594 | A1 | 12/2014 | Kruger | |

FOREIGN PATENT DOCUMENTS

| | | | |
|---|---|---|---|
| DE | 41 33 970 | A1 | 4/1993 |
| FR | 2 731 674 | A1 | 9/1996 |

* cited by examiner

SPINNAKER LAUNCHING AND/OR RECOVERING SYSTEM AND METHOD AND A SAILBOAT COMPRISING THE SPINNAKER LAUNCHING AND/OR RECOVERING SYSTEM

BACKGROUND OF THE INVENTION

Field of the Invention

The present invention relates to a releasably attachable spinnaker launching and/or recovering system for use on a sailboat, such as a yacht, or such as a super yacht, comprising at least one hull and at least one mast extending upright from a deck in the hull, as well as a sailboat comprising a spinnaker launching and/or recovering system.

The present invention also relates to a method for launching and/or recovering of a spinnaker on a sailboat.

Description of Related Art

A spinnaker is a special type of sail for sailboats. Spinnakers are large substantially triangular symmetrical or asymmetrical sails which are designed to be used when going down wind, sailing with the wind 90°-180° off the bow. Asymmetrical spinnakers are also used for reaching, that is sailing with the wind as close as 40°-90° off the bow. Asymmetric spinnakers are sometimes named gennakers.

When the wind fills the spinnaker, the spinnaker "balloons" out in front of the boat, i.e., in front of the mainsail and the jib, when the wind is 90°-180° off the bow.

During reaching, the asymmetric spinnaker fills to the leeward side of the boat, like a very large jib, when the wind is 40°-90° off the bow.

The spinnaker increases the speed of the boat and results in a much more comfortable sailing experience.

A sailboat going down wind or reaching, not launching its spinnaker, is seriously under powered.

The resulting sailing speed is slow and the sailing experience is a disappointing one.

For this reason, a spinnaker is always launched whenever possible in sailing competitions and races, where a skilled crew is handling the sails.

For safety and practical reasons the spinnaker is seldom launched on cruising at leisure trips, e.g. sailing together with family and/or friends. The spinnaker is particularly not launched when only a few persons are on board the yacht, when the yacht is very big, or when the majority of the persons on board are inexperienced in sailing sailboats. Even when conditions are perfect for a memorable fast and enjoyable downwind sailing experience, the spinnaker is seldom launched for safety reasons.

The area of the spinnaker is large in relation to the size of the sail boat and the other sails used on the sail boat. Thus, the forces of the wind acting on the spinnaker are dramatic. Serious injury to persons and damage to the sail or to the rig may easily occur if the spinnaker is not strictly controlled.

A spinnaker out of control is a serious threat even in moderate winds.

Further the spinnaker is rather bulky to handle. For these reasons, it requires the action of several skilled persons to launch, run and recover the spinnaker in a safe and controlled way. In addition, it requires that one or more of the crew leave the cockpit and go to the front deck to assist in launching and/or recovering the spinnaker. Leaving the safety of the cockpit of the sail boat at sea is dangerous, especially in windy weather, in rough waves, at night, during rain, when the deck is wet and slippery, or in any case if an inexperienced sailor is involved.

Traditionally, spinnakers are launched and recovered by hand. Depending on the size of the spinnaker and the wind speed, one, more or as many as 10-15 crew members are engaged on the deck of the sail boat, when the spinnaker is launched or recovered.

Especially recovering the spinnaker by hand the traditional way is a challenge.

Grasping the fabric of the spinnaker trying to control and secure it on the deck, as it is lowered, is certainly neither easy nor without risk.

Spinnakers are usually made of lightweight and strong fabric, usually nylon. The fabric may be selected from a more modern, stronger or a heavier type of fabric if the spinnaker is designed for sailing in windy weather or stormy weather, in particular during sail races.

The head, i.e., top corner, of the spinnaker is attached to the halyard, i.e., which is used for hoisting and lowering the spinnaker. The halyard is attached to the top end of the mast, e.g., through a ring like member, a roller wheel or similar means, and runs down inside, and parallel to the mast. The halyard can be pulled, secured or slacked, respectively, when needed, e.g., from the cockpit of the boat, when it is necessary to set, secure or recover the spinnaker respectively.

A spinnaker may be symmetric or asymmetric.

Symmetric spinnakers are substantially large triangular sails where the angle of the top is unequal to the angles of the two lower corners of the sail, which are identical. A symmetric spinnaker is mounted symmetrically on the boat, i.e., the lines carrying load while sailing are connected to the boat in a symmetrical way in relation to the length axis of the boat. The spinnaker is controlled by lines, such as rope or wire, i.e., a guy and a sheet running from the lower two corners of the sail to the two aft corners of the boat. The windward line is named the guy. It is attached to the windward or tack corner of the spinnaker and is stabilized by a spinnaker pole. The leeward line is called the sheet. It is attached to the leeward or clew corner of the spinnaker. The guy as well as the sheet and the lowering or the raising of the spinnaker pole is used to control the optimal position of the spinnaker relative to the sailboat, and the wind. Further they are used to trim the shape of the sail. During gybing, the spinnaker pole must be moved from the "old windward" to the "new windward" side of the sailboat. During the gybe the sail(s) (main sail and possibly also the jib) are also moved from one side of the boat to the other, as the tack of the sailing boat is changed downwind from starboard to port or vice versa. This procedure is quite difficult and requires a skilled crew.

Asymmetric spinnakers are large substantially triangular sails where the angle of the top is unequal to the angles of the two lower corners of the sail, which are also not identical. An asymmetric spinnaker is set asymmetrically on the boat, i.e., the lines carrying load while sailing are connected to the boat in an asymmetrical way in relation to the length axis of the boat (see FIG. 7). The spinnaker is controlled by lines, such as rope or wire, i.e., a tack line, attaching the tack corner of the sail to the bow of the sailboat in front or behind the forestay or to a (retractable) bowsprit, and an active sheet and a lazy sheet, attaching the clew corner of the sail to the two aft corners of the boat. An asymmetric spinnaker is less difficult to use since it does not require a spinnaker pole. Instead its tack corner is attached to the bow of the hull or to a (retractable) bowsprit by a tack line or a guy. The asymmetric spinnaker is very easy to gybe.

It only requires releasing the active sheet (the leeward sheet) and pulling in the lazy sheet one, as the tack of the sailing boat is changed downwind from starboard to port or vice versa.

There have been several attempts to provide a spinnaker launching and/or recovering system which make it safe and easy to launch and recover spinnakers on sailboats.

One system for launching and/or recovering the spinnaker has for long been used in small sailboats, also called dinghies.

A retrieval line is attached to the center of the spinnaker and the line runs into a ring to which a sleeve is attached. The sleeve and the ring are either releasably attached to the deck of the dinghy, so that the spinnaker in the sleeve can be removed from the dinghy and stored, when not in use, or they are integrated parts of the hull of the dinghy. Sailing, the spinnaker is easily recovered and folded into the sleeve by this system, simply by slacking the halyard and the sheets and by pulling the retrieval line and vice versa when launching the spinnaker. The fact that the system folds the spinnaker as it is recovered is essential. In this way the length of the sleeve needs only be half of the spinnakers length from the head to the tack corner. Folding the spinnaker is important since the spinnakers length from the head to the tack corner normally by far exceeds the full length of the dinghy or sailboat or yacht.

The system works very well on dinghies, but is not suitable for use on larger sailboats e.g., sailboats with keels and/or yachts. The size of the spinnaker in relation to the width of the hull of sailboats or yachts simply renders it impossible to recover the spinnaker by pulling it down in a retrieval line or recovery line attached to the center of the spinnaker without the lower half of the spinnaker including the clew- and tack corner and the sheet lands on the water to the lee and in front of the bow, where it is inevitably sailed over by the boat with a substantial risk of tearing the spinnaker.

Two systems are designed for sailboats or yachts.

The systems share the disadvantage that at sea, crew members have to bring the spinnaker forward to the front deck, where it has to be mounted in the bow, and to be hoisted prior to launching it. Recovering the sail, once again crew members have to enter the front deck, grasping the sail as it is lowered, dismounting it at the bow, and recovering it from the front deck.

In one system, a winding gear or a capstan at the deck near the bow is used to twist or wind the spinnaker around itself between the winding gear on the deck and the halyard at the top end of the mast. The spinnaker is stored wound up, and prior to launching it, crew members have to bring it forward to the front deck of the sail boat, where it is mounted to the winding gear or a capstan at the deck near the bow, and to the halyard. Then the wound up sail is hoisted and may now be launched by unwinding it. To recover the spinnaker it is wound up again, the halyard is lowered, the wound up sail is grasped and secured by crew members on the front deck, dismounted at the bow, and recovered from the front deck.

In theory the wound up spinnaker can be hoisted in the safety of harbor, remain hoisted and wound up sailing upwind, and be launched going down wind or reaching as required, until the sailboat again reaches harbor, where the wound up spinnaker can be lowered in the safety of harbor, dismounted at the bow and recovered from the front deck.

In this way, the spinnaker can repeatedly be launched and recovered without crew members have to leave the safety of the cockpit at sea.

However, this is not common practice due to the obvious risk of strong winds partly unwinding the hoisted wound up spinnaker, tearing it, especially while going up wind.

Even in light winds, going upwind with the large body of the wound up spinnaker hoisted in the mast is an unpractical and clumsy approach, which will slow down the sailboat a lot, and is therefore not undertaken.

A second system uses a "sleeve" which is drawn onto the spinnaker before bringing it to the sailboat. The sleeve is a separate device that is attached between the spinnaker halyard and the spinnaker. The halyard is attached to the top of the sleeve and the head of the spinnaker is attached to the inside of the sleeve, e.g., with a swivel snap shackle. To help guide the spinnaker into the sleeve there is a large circular or oval fiberglass- or plastic ring at the lower end opening of the sleeve. In order to fit over the entire spinnaker, the sleeve needs to be relatively large for the spinnaker size. In use, the fiberglass ring followed by the sleeve is pulled downwards over the spinnaker to "snuff" the air out of it before bringing it to the sailboat.

The spinnaker is stored "snuffed" in the sleeve and prior to launching it, crew members have to bring it forward to the front deck of the sail boat, where it is mounted to the deck near the bow, and to the halyard. Then the "snuffed" spinnaker is hoisted and may now be launched by hoisting the sleeve itself to the top of the mast. To retract the spinnaker, it is "snuffed" again by lowering the sleeve from the top of the mast, the halyard is lowered and the "snuffed" spinnaker is grasped and secured by crew members on the front deck, dismounted at the bow, and recovered from the front deck.

In theory the "snuffed" spinnaker can be hoisted in the safety of harbor, remain hoisted and "snuffed" sailing upwind, and be launched going down wind or reaching as required, until the sailboat again reaches harbor, where the "snuffed" spinnaker can be lowered in the safety of harbor, dismounted at the bow and recovered from the front deck.

In this way, the spinnaker can repeatedly be launched and recovered without crew members have to leave the safety of the cockpit at sea.

However, this is not common practice due to the obvious risk of strong winds tearing the hoisted "snuffed" spinnaker, especially while going upwind.

Even in light winds, going upwind with the large body of the snuffed spinnaker hoisted in the mast is an unpractical and clumsy approach, which will slow down the sailboat a lot, and is therefore not undertaken.

SUMMARY OF THE INVENTION

Thus, it is an object of the present invention to provide a method and a system for launching and/or recovering a symmetric or asymmetric spinnaker on sailboats, which do not suffer from the above mentioned disadvantages.

It is also an object of the present invention to provide a method and a system for launching and/or recovering a symmetric or asymmetric spinnaker on sailboats such as yachts, in particular larger sail boats with keels, where a spinnaker of moderate size can be repeatedly launched and/or recovered manually by a single person, positioned in the safety of the cockpit, simply by pulling and slacking lines.

It is also an object of the present invention to provide a method and a system for launching and/or recovering a symmetric or asymmetric spinnaker on sailboats such as yachts, in particular larger sail boats with keels, where a spinnaker of large size repeatedly can be launched and/or recovered manually by a number persons positioned in the safety of the cockpit, simply by pulling and slacking lines.

It is also an object of the present invention to provide a method and a system for launching and/or recovering a symmetric or asymmetric spinnaker on sailboats such as yachts, in particular larger sail boats with keels, where a spinnaker of large, very large or even extremely large size repeatedly can be launched and/or recovered by means of motorized capstans or winches or similar means conventionally used in connection with motorized means for pulling lines on yachts, e.g., halyards, or sheets, operated by a single person positioned in the safety of the cockpit or of the hull of the yacht.

It is also an object of the present invention to provide a method and a system for launching and/or recovering a symmetric or asymmetric spinnaker on sailboats such as yachts, in particular larger sail boats with keels, where a spinnaker of any size can be mounted in the safety of harbor, remain mounted and protected from the destructive forces of the wind at sea, and be repeatedly launched and recovered from the cockpit by hoisting and lowering it as required, simply by pulling and slacking lines manually or by means of motorized capstans or winches or similar means conventionally used in connection with motorized means for pulling lines on yachts, until the sailboat again reaches harbor, where the spinnaker can be safely dismounted.

In this way, the spinnaker can repeatedly be hoisted and lowered without crew members have to leave the safety of the cockpit at sea.

It is also an object of the present invention to provide a method and a system for launching and/or recovering an asymmetric spinnaker on sailboats such as yachts, in particular larger sail boats with keels, without the use of special retrieval lines and thus is highly suitable for use with conventional asymmetric spinnakers on existing sailboats, i.e., there no need to purchase another spinnaker with a retrieval line or to modify the existing spinnaker to include a retrieval line.

In addition, the present invention provides a method and a system for launching and/or recovering a asymmetric spinnaker by means of the lines used for launching and controlling the spinnaker during sailing, in particular the tack line and the halyard.

It is also an object of the present invention to provide a method and a system for launching and/or recovering a symmetric spinnaker on sailboats such as yachts, in particular larger sail boats with keels with the use of a retrieval line, which may be attached to the tack corner of conventional spinnakers on existing sailboats, i.e., there no need to purchase another spinnaker with a special fitted retrieval line or to modify the existing spinnaker to include a retrieval line.

Thus, it is also an object of the present invention to provide a method and a system for launching and/or recovering a symmetric or asymmetric spinnaker, which can be built onto the deck or into the hull of a new or an existing sailboat.

Further, it is also an object of the present invention to provide a system for launching and/or recovering a spinnaker, which is portable and can be removed from the boat, when not in use, and which is highly suitable for use with existing spinnakers on existing sailboats.

Further, it is an object of the present invention to provide a method and a system for launching and/or recovering a symmetric or asymmetric spinnaker on larger sailboats, which can be used for easy and safe stowing of the spinnaker when the spinnaker is not in use, at harbor and during sailing.

Finally, the present invention relates to the use of the method and spinnaker launching system on a sailboat, such as a yacht, for launching and/or recovering the spinnaker.

These objects are met by a spinnaker launching and/or recovering system, as mentioned in the preamble, which comprises a first spinnaker guiding member, such as a ring member and/or a hatch, which is releasably attachable to the deck near the bow, or to a bowsprit or is integrated onto or into the deck near the bow, and said first spinnaker guiding member comprises an opening through which a tack line attached to the tack corner and/or a retrieval line attached to the clew corner or to the lower luff of an asymmetric spinnaker and the spinnaker itself is intended to be guided during launching and/or recovering thereof, or said first spinnaker guiding member comprises an opening through which retrieval lines attached to the tack corner and/or the clew corner or to the lower luff of a symmetric spinnaker and the spinnaker itself is intended to be guided during setting and/or recovering thereof.

In the present invention, the spinnaker is recovered by slacking the halyard and by pulling in either the tack line attached to the tack corner of an asymmetric spinnaker or the retrieval line attached to the clew corner of an asymmetric spinnaker. The system thus may use the lines already used for launching, running, recovering and/or controlling a conventional asymmetric spinnaker.

On a symmetric spinnaker, retrieval lines are attached to the tack corner and to the clew corner or to the lower luff of the spinnaker.

The tack line or the retrieval lines is/are directed through the first spinnaker guiding member as described above, and may further be guided around the second spinnaker guide member as described below.

Thereby, the system can be used for setting and/or recovering a spinnaker on sailboats with the existing asymmetric or symmetric spinnaker and largely without the need for modifying the existing spinnaker.

In practice, it appears easier to lower the symmetric spinnaker by pulling the recovery line attached to the clew corner. In certain conditions, it is also found to be easier to lower the asymmetric spinnaker by pulling the recovery line attached to the clew corner.

Further, the spinnaker launching and/or recovering system, may preferably comprise at least one second spinnaker guiding member, releasably attachable to the deck or below deck, or build in onto or below deck, around which the tack line or the retrieval line and at least part of the spinnaker itself is intended to be guided after passing through the first spinnaker guiding member. Thus, the spinnaker is folded around the second spinnaker guide member when it is recovered. This reduces the length of the spinnaker when resting in the spinnaker launching and/or recovering system.

Using the tack line or the retrieval line attached to the clew corner or to the lower luff recovering asymmetric spinnakers or using the retrieval line attached to the tack corner or to the clew corner or to the lower luff of a symmetric spinnaker substantially reduces or even eliminates the risk of the spinnaker landing on the water to the lee and in front of the bow during recovering, and thus, also reduces or eliminates the risk of damaging the spinnaker by subsequently sailing over it or tearing it.

Hereby, is also obtained that the spinnaker can be launched and/or recovered without the need for any of the crew going to the front deck to assist in hoisting or recovering the spinnaker manually. The system enables a small crew, or even a single person to hoist and launch the spinnaker from its resting position in the spinnaker launching and/or recovering system on or below the deck, where it is protected from the destructive forces of the wind and the sea and/or to lower and recover the spinnaker back to the resting position, simply by pulling and/or slacking the respective lines (as explained above and further below) while staying in the cockpit. In addition the system allows an inexperienced or under staffed crew or even beginners to sail with a spinnaker, in particular an asymmetric spinnaker.

The system is especially suitable for use with asymmetric spinnakers, because an asymmetric spinnaker requires no spinnaker pole.

The system is also highly suitable for use with symmetric spinnakers. However, a symmetric spinnaker requires a spinnaker pole, which at least during the gybe must be operated by crew members on the fore deck. The hoisting and the lowering of the spinnaker pole may be controlled by lines from the cockpit. The tack end of spinnaker pole used on symmetric spinnakers may comprise a remotely controllable hook, which can release the tack sheet from the spinnaker pole end, e.g., by means of a wire attached to a spring loaded lever in the gate of the hook.

In addition, the system enables safe storing of the spinnaker during sailing without spinnaker, up wind or in very strong winds, such as below deck or inside the sleeve or in a bag in the cockpit end of the sleeve on the deck, which is described further below. The spinnaker is secured in the sleeve or below deck simply by taking the slack out of the lines attached to the sail.

The second spinnaker guiding member comprises a roller wheel, a capstan, a ring member, a carabineer or similar means suitable for guiding the tack line and at least part of the spinnaker itself, and thus folding the spinnaker, after passing through the first spinnaker guiding member.

A tack line guiding means is preferably attached to the bow end area of the deck, or to the outside surface of the first spinnaker guide means, or alternatively passed through an opening in the hull or the deck in the bow end area for passing the tack line below deck to the cockpit area. Thereby the tack line or the retrieval line of an asymmetric spinnaker or the retrieval lines of a symmetric spinnaker can be used for pulling the spinnaker through the first spinnaker guide member, around the second spinnaker guide member turning it towards the bow to enable the folding thereof and subsequently pass the tack line or the retrieval line around the tack line guiding means pointing the line back towards the cockpit area in the aft of the hull. The tack line or retrieval line guiding means comprises a roller wheel, a capstan, a ring member, a carabineer hook or the like.

When the spinnaker launching and/or recovering system further comprises one or more second spinnaker guiding members, and optionally a tack line or retrieval line guiding means, such as a roller wheel, a capstan, a ring member, a carabineer or similar means, intended for guiding the tack line or retrieval line and subsequently the spinnaker itself through the first spinnaker guide member and on to the second spinnaker guiding means folding it back towards the bow end of the sailboat. Via the optional next one or more second spinnaker guiding members, the spinnaker is folded further back towards the aft end of the sailboat etc. Thus, it is possible to guide the spinnaker around several second spinnaker guide members and reverse the pulling direction several times. Thereby, it becomes possible to store even a very large or an extremely large spinnaker in a limited space on or below deck, i.e., well in front of the mast, even though the spinnaker is very bulky and the overall length of the spinnaker is by far larger than the entire length of the hull.

The first spinnaker guide member is preferably a ring member, which can be secured to the bow, the bowsprit or simply to the deck near the bow by attachment means usually provided on board of boats, such as a rope, wire, brackets, shackles or a combination thereof. The ring member can be of any form, and only needs to provide for a suitable passage of the tack line and subsequently of the spinnaker itself through the ring member, which is large enough and shaped to smoothly guide the spinnaker itself through the passage during launching and recovering of the spinnaker. The attachment means of the ring member are e.g a rope or wire means which are secured to the deck by a bracket or a shackle or the like securing means conventionally used on boats The attachment means can e.g., be provided simply by the shape of the ring member, such as a cylindrical ring member, where the wall is concave in the axial direction, i.e., the diameter at the middle is reduced in relation to the diameter at the ends of the cylinder.

The second spinnaker guide member is preferably one or more blocks, capstans or rollers of suitable shape and size, which enable the tack line and subsequently the spinnaker itself be drawn around it. The second spinnaker guide member is built in on or below deck, or it is releasable attachable to the deck by means of a rope or wire means which are secured to the deck or by a bracket or a shackle or the like securing means conventionally used on boats. The second spinnaker guide member are preferably secured to the deck in the vicinity of the cockpit to provide a suitable distance to the first spinnaker guide member, which allows for storage of the spinnaker on or below deck between the first and second spinnaker guide member by passing the spinnaker around the second spinnaker guide member, folding it.

Preferably, the first spinnaker guide member and the second spinnaker guide member are connected by a sleeve. The sleeve is preferably a textile sleeve, such as made of Nylon or similar textiles conventionally used on boats, e.g., for sails. The textile is preferably waterproof, e.g., by a water proofing coating as is well-known in the art. This provides for the system as a single unit, which is can be made portable and easy to install in the safety of harbor on existing boats. This also enables safe storing of the spinnaker on deck, e.g., at sea when sailing without the spinnaker, upwind in strong winds or when not sailing. Safe storing is obtained by taking the slack out of the lines attached to the spinnaker, or by securing the spinnaker in a bag in the cockpit end of the sleeve. In addition, the sleeve results in that it is easy to handle when detaching the system from the boat in the safety of harbor and stowing away the spinnaker, e.g., below deck. If a bag is used, the second spinnaker guide means may be contained in the bag. Thereby, it becomes easy to pack the spinnaker into the bag, since the crew only needs to handle the sleeve and the first spinnaker guide member when putting the spinnaker into the bag. Alternatively, the sleeve may be a somewhat rigid sleeve, e.g., of metal, such as stainless steel or aluminium or made of plastic material, e.g., polyethylene (PE), polypropylene (PP) polyester (PET) or the like. A rigid sleeve is particularly well suited for mounting permanently to the deck of the boat, or it may be built into the hull of the boat and can be used for safe storing of the spinnaker when the boat is in harbor or at sea.

The system comprises an opening for the tack line or retrieval line. The opening is preferably provided in the body of the first spinnaker guide member or at a part of the sleeve which is preferably closer to the first spinnaker guiding means than the second spinnaker guide means. This enables reversing the spinnaker inside the sleeve after being pulled, or folded, around the second spinnaker guide member. The tack line or retrieval line is turned through the tack line guiding means, a block preferably on the deck guiding it in the direction of the cockpit. Alternatively, the tack line or retrieval line can return through the opening in the first spinnaker guide means in reverse direction and thereafter be guided in the direction of the cockpit for fastening, pulling or slacking respectively. Hereby is obtained that the entire spinnaker can be stored inside the sleeve, because the tack line attached to the tack corner or the retrieval line attached to the clew corner of the spinnaker is then able to draw the spinnaker through the first spinnaker guide member, the ring member, through the sleeve, and around the second spinnaker guide member returning the spinnaker towards the bow inside the sleeve, thus folding the spinnaker around the second spinnaker guide member or members.

Alternatively, the system is built into the boat. In a built-in version, the first spinnaker guiding means is provided by at hatch opening in the deck, and preferably with a hinged cover. The hatch is preferably provided in the deck near the bow. One or more second spinnaker guide members are provided below deck where they are secured to the hull or the underside of the deck.

The built-in version may further comprise a partial sleeve with a first spinnaker guide member, such as a ring member, at the bow end of the sleeve and its second end attached to a hatch opening in the deck for guiding the tack line or retrieval line and the spinnaker through the hatch and below deck. This enables the first spinnaker guide members to be releasably attached near the bow or to a bowsprit, e.g., a retractable bowsprit. The spinnaker is preferably stored below deck and the partial sleeve with the first spinnaker guide member can be pulled out of the hatch and is attached near the bow or to a bowsprit, e.g., a retractable bowsprit, making the system ready for launching the spinnaker, preferably before sailing out of harbor.

In any variant, the tack line or retrieval line may be guided from the bow area to the cockpit above or below deck.

The pulling and slacking of the tack line or retrieval line, the halyard, the second tack line and/or the sheets can be carried out manually or by means of a motorized capstan or winch or similar means conventionally used in connection with motorized means for pulling lines on yachts, e.g., halyards, or sheets.

The objects of the invention and the above mentioned advantages are also met by means of a method for setting and/or recovering a spinnaker on a sailboat. The method comprises guiding the tack line attached to the tack corner and/or a retrieval line attached to the clew corner or to the lower luff of an asymmetric spinnaker or one or more retrieval lines attached to the tack corner and/or the clew corner or to the lower luff of a symmetric spinnaker and subsequently the spinnaker itself through an aperture in a first spinnaker guiding member, which is releasibly attachable to the bow, a bowsprit or to or in the deck near the bow, into the sleeve and optionally around at least one second spinnaker guiding member and/or tack line and/or recovery line guiding member, attachable to the deck or below deck, and optionally through tack line or recovery line guiding means for guiding the tack line or the recovery line to the cockpit in the rear end of the sailboat, optionally by initially guiding the at least one tack line and/or recovery line from the second spinnaker guiding means towards the bow end of the sailboat and, via the tack line or spinnaker recovery line guiding member back towards the cockpit.

A simplified variant of the method comprises guiding a tack line attached to the tack corner and/or a retrieval line attached to the clew corner or to the lower luff of an asymmetric spinnaker or retrieval lines attached to the tack corner and/or the clew corner or to the lower luff of a symmetric spinnaker and subsequently the spinnaker itself through an aperture in a first spinnaker guiding member, which is releasably attachable to the bow, a bowsprit or to or in the deck near the bow, and into a sleeve.

The simplified variant thus only comprises a first spinnaker guiding member attached to a sleeve.

As mentioned above in relation to the system, the method further comprises recovering the spinnaker by slacking the halyard, the optional second tack line and the sheets and simultaneously pulling the tack line or the recovery line and subsequently the spinnaker itself through the first spinnaker guide member, around the second spinnaker guide member, and optionally pulling the tack line or the recovery line via the tack line or recovery line guiding means. Thereby the spinnaker is guided through the first spinnaker guide means, and at least a part of the spinnaker is further guided around at least one second spinnaker guide means.

Thus, the spinnaker is folded and stored in the spinnaker launching and/or recovery means comprising the first spinnaker guide member, the sleeve and at least one second spinnaker guide member.

The simplified variant, implicates that the lower part of the spinnaker is guided through the first spinnaker guide means by pulling the tack line or the recovery line or lines and subsequently as the tack corner, the lower luff or the clew corner reaches the cockpit end of the sleeve, the remainder of the spinnaker is recovered into the sleeve, either by grasping the fabric of the spinnaker itself by hand, pulling the spinnaker into the sleeve, while staying in the cockpit, or by pulling one or more helper lines attached approximately a sleeves length or more up along the leading edge/the luff (tack) and/or the rear edge (clew) of the spinnaker. This helper line system is applicable in a system for use with setting and/or recovery of asymmetric spinnakers as well as with symmetric spinnakers.

A leading helper line is preferably secured to the tack side of an asymmetric spinnaker. A rear helper line is secured to the clew side of the spinnaker.

Thus, the lower part of the spinnaker is preferably guided through the first spinnaker guide means by pulling the tack line or the recovery line or lines and subsequently as the tack corner or the clew corner reaches the cockpit end of the sleeve, and where a next part of the of the spinnaker is recovered into the sleeve by pulling at one or more helper lines attached with the top end thereof at a sleeves length or more up the leading edge/luff from the tack corner and/or the rear edge of the spinnaker from the clew corner.

Preferably, one or more additional helper lines are attached above the first helper line or the first set of helper lines for pulling one or more further parts of the spinnaker into the sleeve.

Pulling in the helper line or lines will bring another sleeves length or more of the spinnaker into the sleeve. In case the spinnaker is too large to be fully recovered into the sleeve or bag using one (set of) helper line(s), one or more additional (sets of) helper lines may be attached to the spinnaker at a approximately a sleeves length up the leading edge (tack) and/or the rear edge (clew) of the spinnaker, i.e., above the first (set of) helper line(s).

Pulling tack lines, retriever lines and helper lines may be applied by using pulling and/or slacking means, such as pulling/slacking means already installed at the boat, such as hand driven or motorized capstans or winches or similar means conventionally used in connection with hand driven or motorized means for pulling and slacking lines on yachts, e.g., halyards, or sheets may be used.

After being recovered and until being launched again the spinnaker is safely stored and secured in the sleeve on or under deck by taking the slack out of the lines attached to it.

The spinnaker is launched by reversing the order of actions, i.e., by pulling the spinnaker out of the spinnaker launching and/or recovering system by slacking the tack line, the one or more helper lines or the recovery line and simultaneously pulling the halyard to raise the spinnaker's head and secure it to the top of the mast and pulling the leeward sheet or the guy and the sheet to launch the spinnaker.

The objects of the present invention are also met by means of a sailboat with a spinnaker setting and/or recovery system as described above.

In the following, the invention will be described in detail with reference to the accompanying drawings.

DETAILED DESCRIPTION OF THE INVENTION

Figure 1:
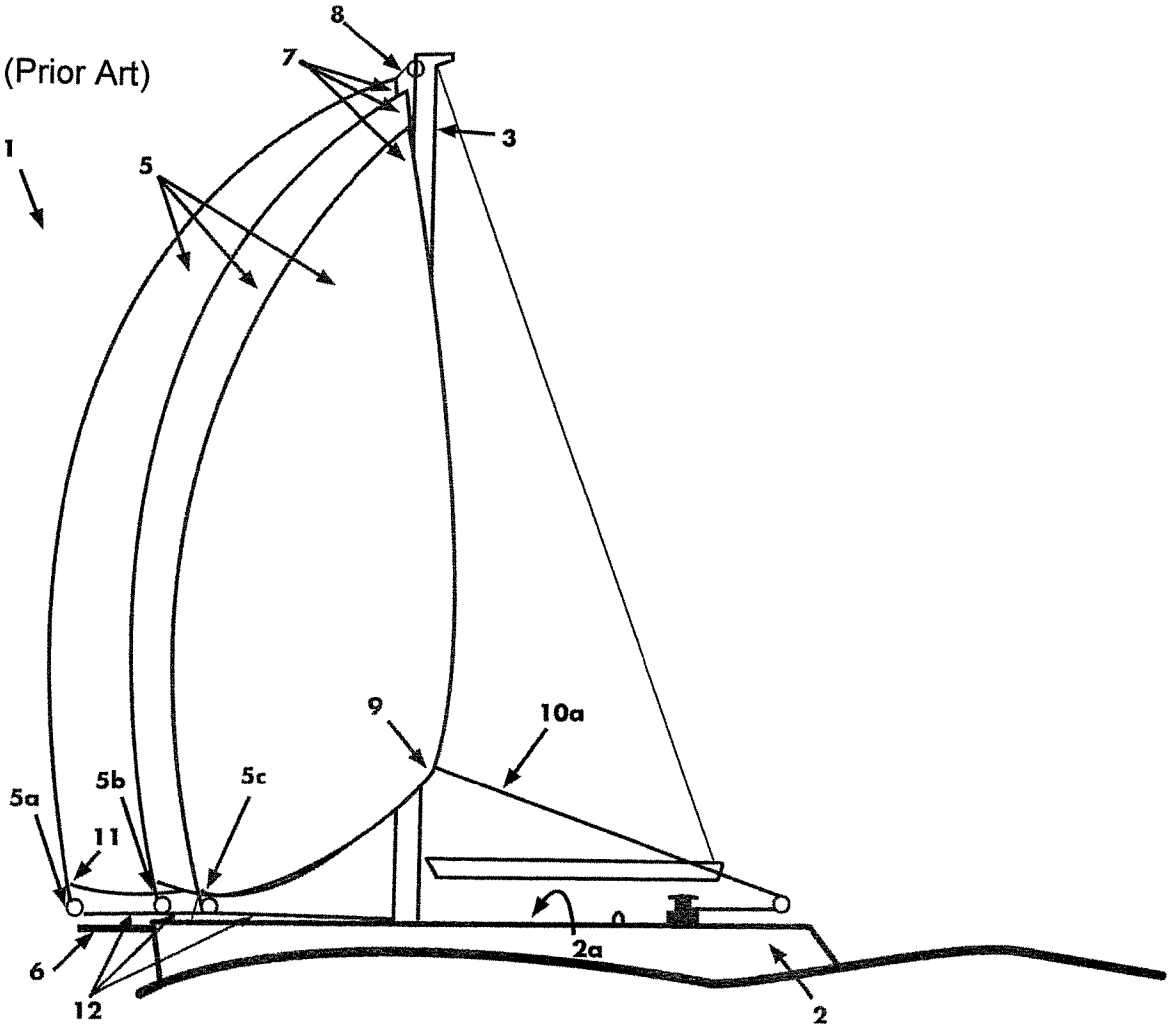
Fig. 1 (Prior Art)
FIG. 1 shows a side view of a sail boat, in the present case a yacht, with an asymmetric spinnaker set as known in the art.

FIG. 1 shows a side view of a sail boat 1, in the present case a yacht, with an asymmetric spinnaker launched for sailing as known in the art.

Throughout the present application a sail boat is explained in relation to a yacht, i.e., a sail boat comprising at least one hull and at least one mast, such as a yacht or a super yacht. The present invention is, however, also applicable on other types of sail boats e.g., catamarans and in certain embodiments also on dinghy type sailboats.

The sailboat comprises at least one hull 2 with a deck 2*a* and at least one mast 3 which holds the sails when sailing. A boom can be mounted to mast 3 by conventional fittings as are well known. The mast 3 and the boom can support a main sail, not shown, as is likewise well known. The mast 3 can also be provided with stays, where only the fore stay 4 is shown in some of the drawings, to support the mast 3 as is well known in the art.

At least one sail can be an asymmetric spinnaker sail 5 that can be somewhat triangular in shape and is shown fully raised in FIG. 1. The spinnaker 5 comprises a tack corner 11, the lower front corner of the spinnaker 5, which is attached to the bow of the hull 2 in front or behind the fore stay 4 or to a bowsprit 6, e.g., a retractable bowsprit 6 by means of a tack line 12. The clew corner 9, the lower corner of the spinnaker 5, is attached to a sheet 10*a* which is connected to the leeward aft corner of the boat and which is carrying load, and a lazy sheet 10*b* (not shown on FIG. 1, see FIG. 7), connected to the windward aft corner of the boat, and which is not carrying load, as is well known in the art. The head 7 of the spinnaker 5 is connected to a spinnaker halyard 8 for hoisting the spinnaker 5 to the top end of the mast 3.

The tack corner 11 of the asymmetric spinnaker may by the tack line 12 be connected to a bowsprit 5*a*, to the deck 2*a* of the hull 2 in front of the fore stay 5*b*, or to the deck of the hull behind the fore stay 5*c*.

In the latter case, the halyard 8 exits the mast 3 under the fore stay (not shown in FIG. 1)

Figure 2:
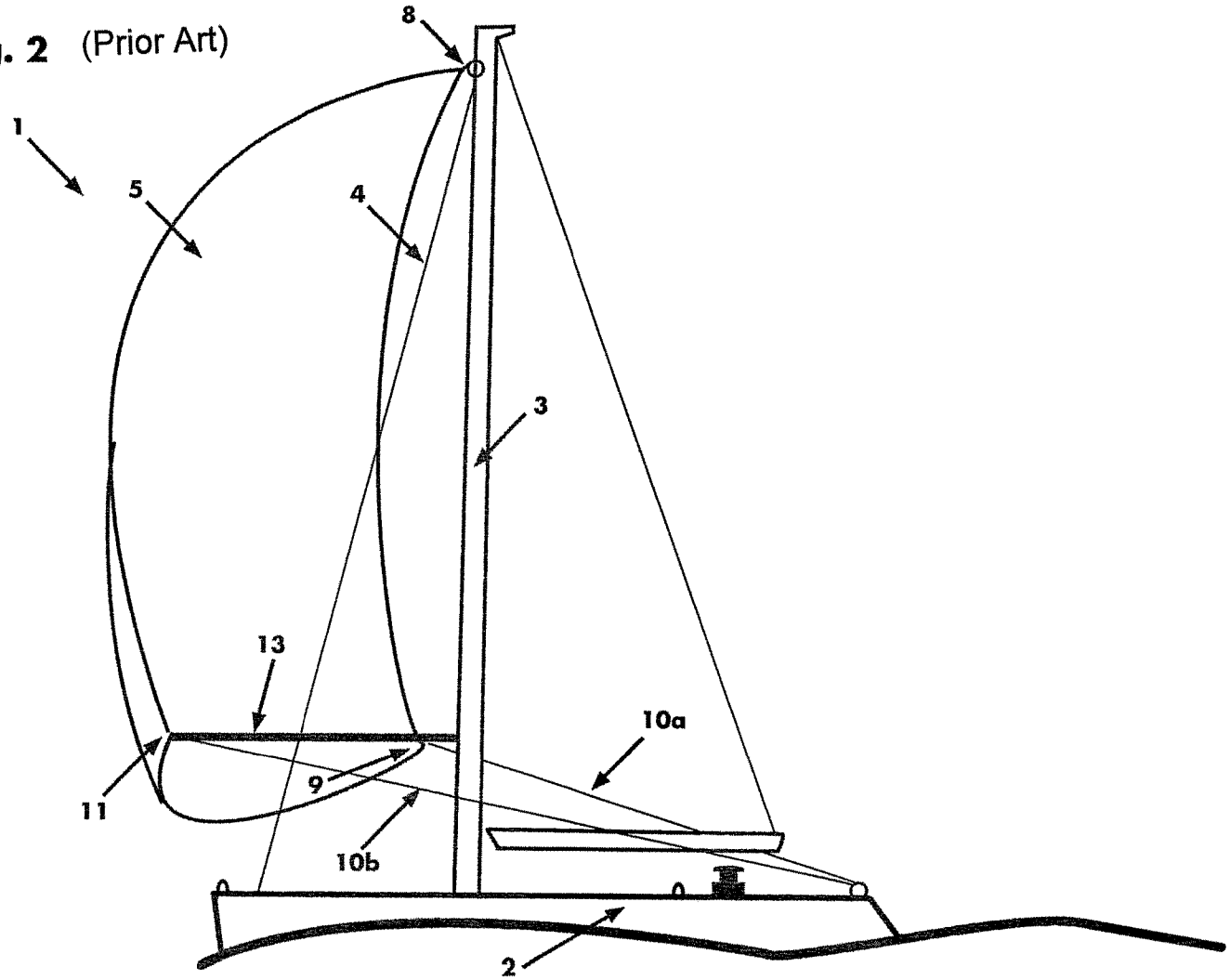
Fig. 2 (Prior Art)
FIG. 2 shows a side view of a sail boat, here also a yacht, with a symmetric spinnaker launched for sailing as is known in the art.

FIG. 2 shows a side view of a sail boat 1, here also a yacht, with a symmetric spinnaker 5 launched for sailing as is known in the art.

The tack corner 11 of a symmetric spinnaker 5 is attached to the outer end of a spinnaker pole 13 by means of a windward sheet 10*b*, also named a guy connected to the windward aft corner of the boat. The spinnaker pole 13 is usually attached to the mast 3 in the other end. The clew corner 9 of the spinnaker is attached to a sheet 10*a*, which is connected to the leeward aft corner of the boat, as described above.

Figure 3:
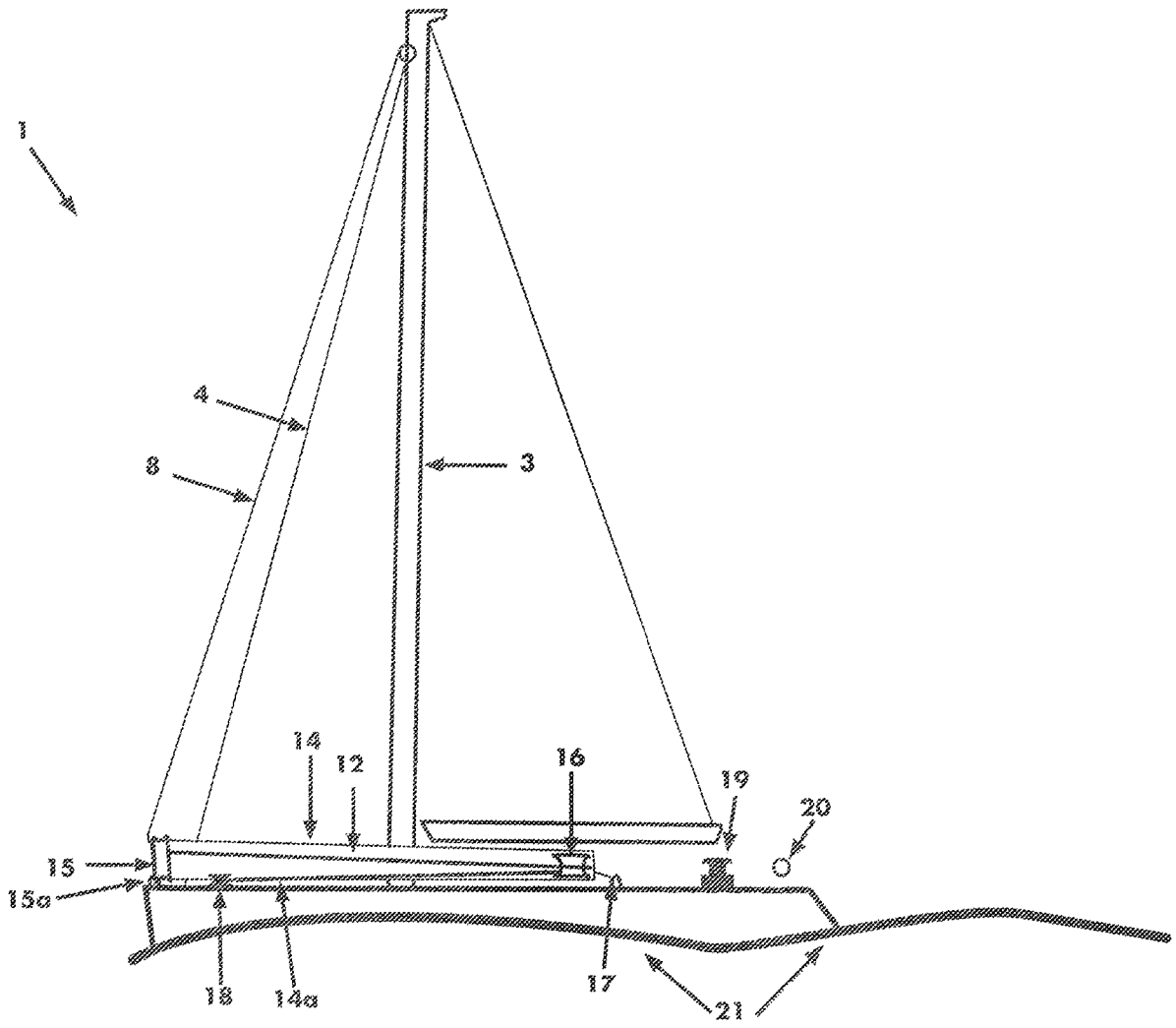
FIG. 3 shows a detailed side view of a sail boat, in the present case a yacht, and a first embodiment of the spinnaker launching and/or recovery system reversely attachable to the deck according to the present invention.

FIG. 3 shows a detailed side view of a sail boat 1, in the present case a yacht, and a first embodiment of the spinnaker launching and/or recovery system releasably attachable to the deck according to the present invention.

A first spinnaker guide member 15 comprises an opening (not shown, see FIG. 17) through which a tack line 12 of the spinnaker and the spinnaker 5 (not shown) itself is intended to be guided during launching and/or recovering thereof. The first spinnaker guide member 15 is e.g., a cylindrical member, a ring member, a funnel shaped member or a polygonal body with a through-going opening.

The first spinnaker guide member 15 is attached to the deck near the bow as shown by a first set of attachment means 15*a* or alternatively it can be attached to a bowsprit 6. A sleeve 14, e.g., a textile sleeve, or optionally a rigid tube shaped sheath (not shown), connects the first spinnaker guide member 15 and at least one second spinnaker guide member 16.

The second spinnaker guide member 16 is attachable to the deck 2*a*, or below deck as described further below, and is, e.g., a block, or alternatively a capstan, a roller or the like member which may rotate about an axis which is substantially perpendicular to the deck 2*a*. The second spinnaker guide member 16 is attached to the deck (2*a*) near the cockpit end and/or near the foot of the mast 3. The second set of attachment means 17 for attaching the second spinnaker guide is, e.g., a bracket or a shackle. The second spinnaker guide member 16, and the bracket or shackle is preferably tied firmly to the deck, e.g., by rope, wires or similar attachment means.

The tack line 12 is here shown attached to the halyard 8. The tack line 12 is drawn through the first spinnaker guide member 15 and the sleeve 14, around the second spinnaker guide member 16 and passes out of the sleeve 14 at the tack line aperture 14*a* in the bow end area of the sleeve 14. Further the tack line passes the tack line guide means 18 turning it back in the direction of the cockpit area of the boat 21. The tack line guide member 18 is here illustrated as a roller attached to the deck 2*a* in the range between the bow and the tack line opening 14*a*. The tack line guide means 18 may alternatively be attached to outer surface of the first spinnaker guide member 15. From the tack line guide means, the tack line is guided towards the cockpit area 21 of the boat, where it is secured.

The tack line 12 and at least part of the spinnaker 5 is intended to be guided around the second spinnaker guide member 16, folding it after passing through the first spinnaker guiding member 15.

Figure 4:
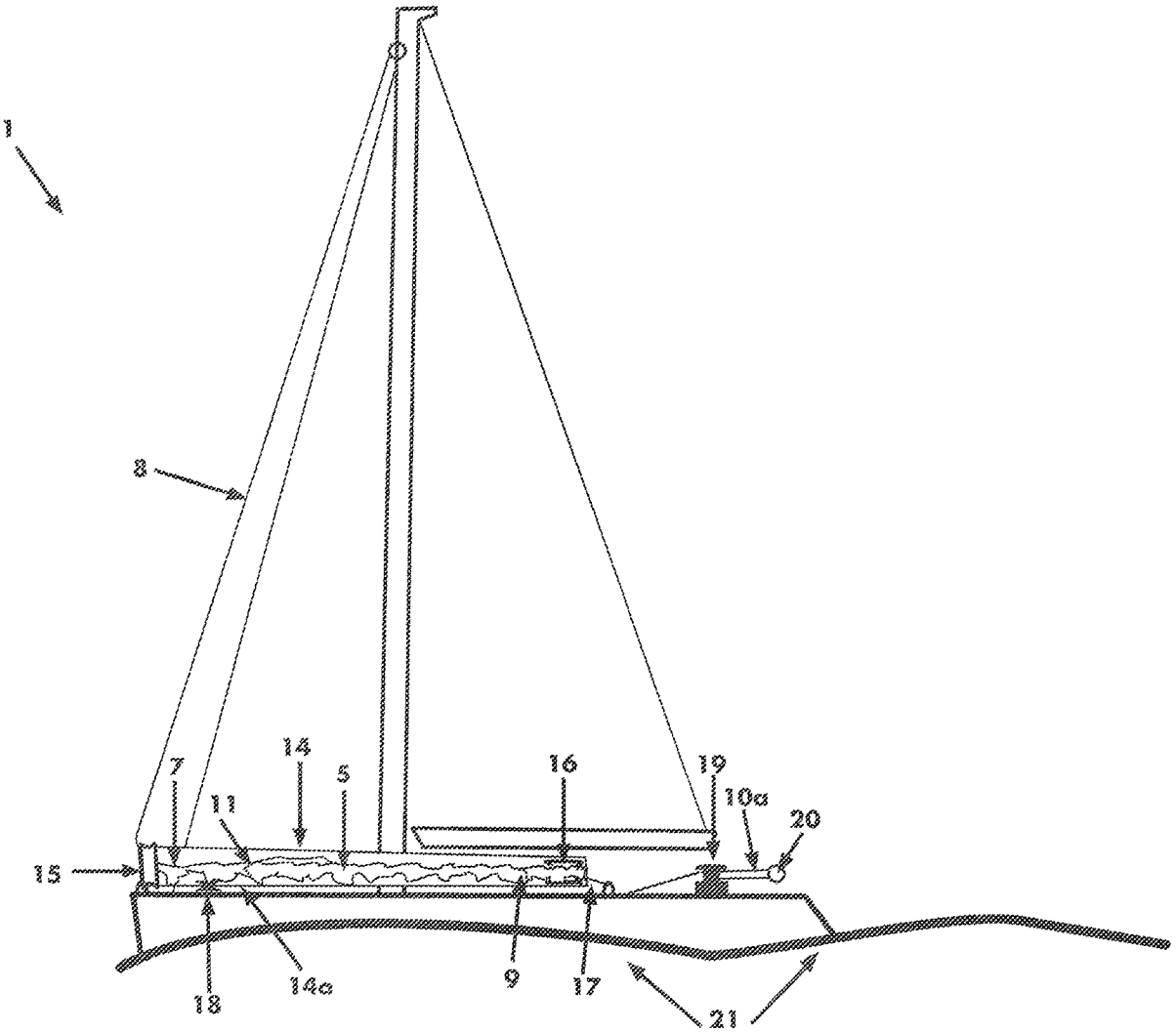
FIG. 4 shows a detailed side view of a sail boat with an asymmetric spinnaker resting in the spinnaker launching and/or recovery system releasably attachable to the deck according to the present invention, where the spinnaker is secured in the launching and/or recovery system and is ready to be launched for sailing.
Figure 5:
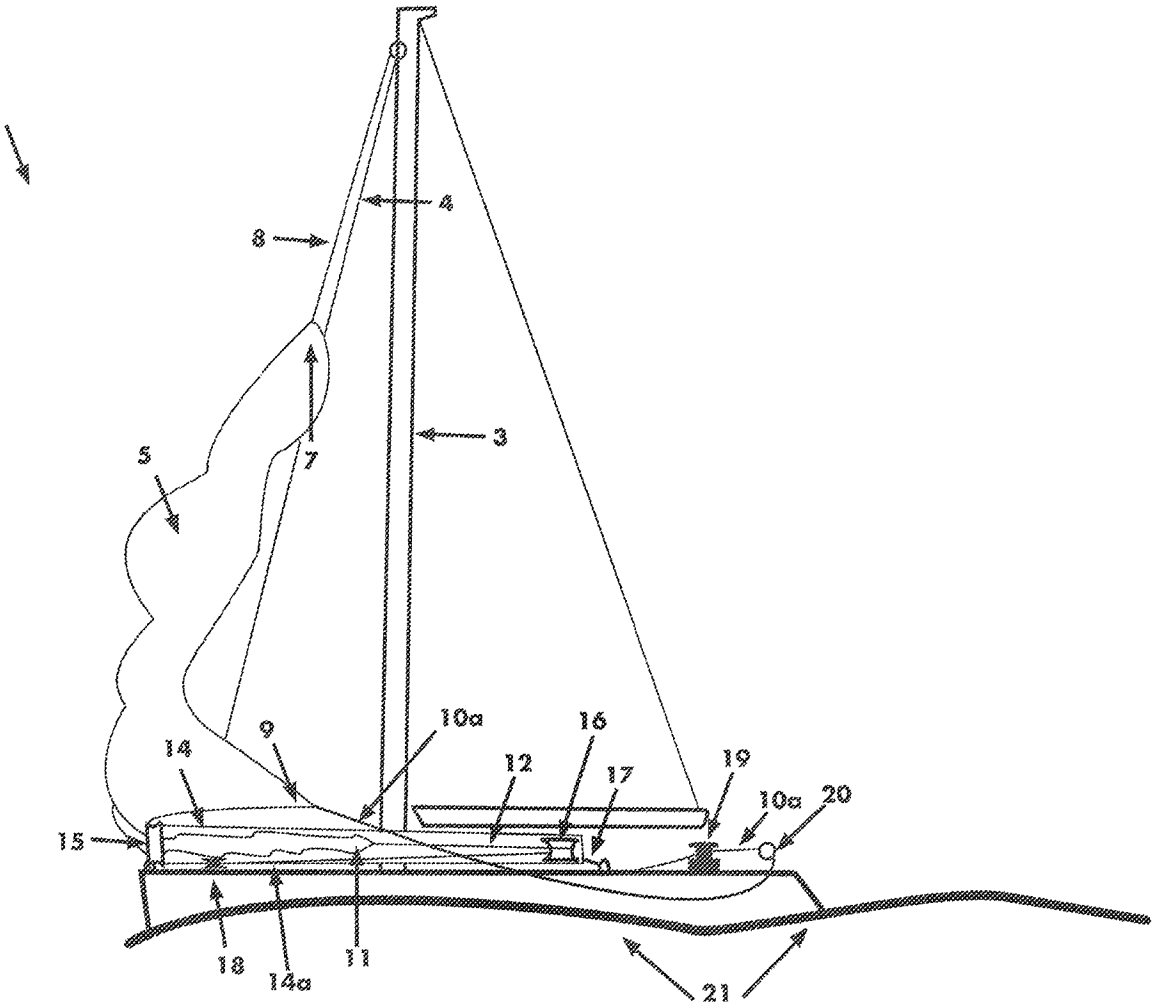
FIG. 5 shows a detailed side view of a sail boat with an asymmetric spinnaker and a launching and/or recovery system releasably attachable to the deck according to the present invention, where the spinnaker is partially launched from the spinnaker launching and/or recovery system. Or, it shows the spinnaker partially recovered into the spinnaker launching and/or recovery system.
Figure 6:
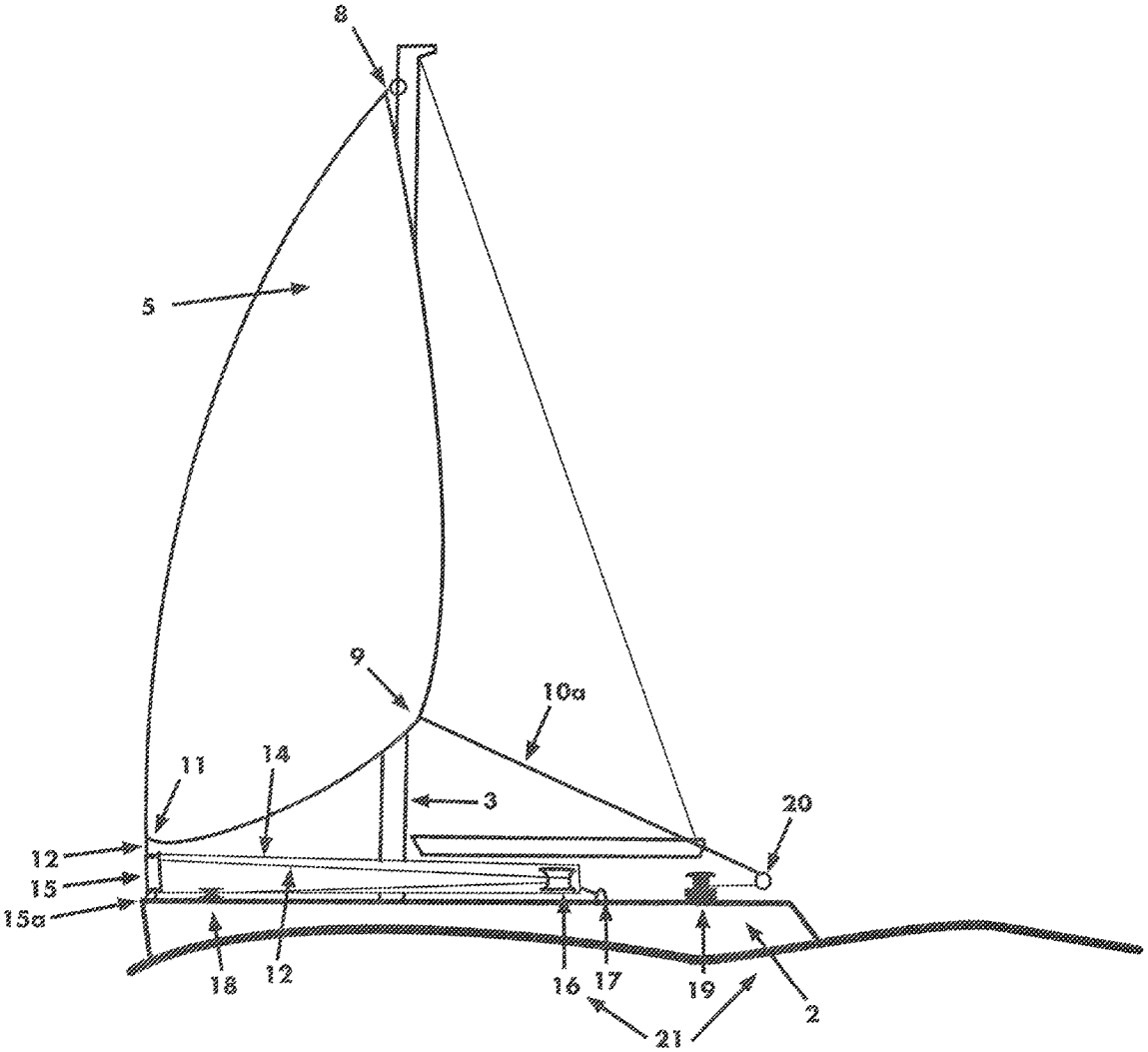
FIG. 6 shows a side view of a sail boat sailing with an asymmetric spinnaker and a spinnaker launch and/or recovery system releasably attachable to the deck, according to the present invention, where the spinnaker is fully launched for sailing.

The launching and recovering is explained in relation to asymmetric spinnakers and is shown in FIGS. 4-6.

FIG. 4 shows a detailed side view of a sail boat 1 with an asymmetric spinnaker resting in the spinnaker launching and/or recovery system reversely attachable to the deck according to the present invention, where the spinnaker 5 is ready to be launched for sailing.

The tack line 12 is attached to the tack corner 11 of the spinnaker. The tack corner is resting in the sleeve 14 near the tack line aperture 14*a* of the sleeve 14 in the bow end area of the sleeve. The halyard 8 is attached to the top 7 of the spinnaker which is resting in the sleeve 14 just inside the first spinnaker guide member 15. The sheets 10*a*, 10*b* (not shown here) are attached to the clew corner 9 of the spinnaker. The clew corner is resting in the sleeve 14 near the second spinnaker guide member 16.

FIG. 5 shows a detailed side view of a sail boat 1 with an asymmetric spinnaker and a launching and/or recovery system releasibly attachable to the deck according to the present invention. The spinnaker is partially launched from the spinnaker launching and/or recovery system. FIG. 5 also shows the corresponding situation where the spinnaker is partially recovered into spinnaker launching and/or recovery system.

The halyard 8 attached to the head of the spinnaker 7 is pulled, hoisting the sail, the slack of the sheets 10*a* and 10*b* attached to the clew corner 9 are pulled, while simultaneously slacking the tack line 12 from the cockpit area. The tack corner 11 of the spinnaker 5 is thus pulled around the second spinnaker guide member 16, as the spinnaker is launched, the halyard pulling it out of the spinnaker launching and/or recovery system through the first spinnaker guide member 15

As can be seen on particularly FIG. 5 there is no risk during launch or recovery that the spinnaker or the sheets lands at the surface of the sea in front of the sailboat, if the crew coordinates the slacking speed of the tack line 12 with the pulling speed of the halyard 8 and the sheets 10*a* and 10*b*.

It is clear that slacking 1 meter of the tack line 12 largely must be balanced by pulling the same length of halyard.

During launching the sail, at first the slack of the sheets which is produced as the sail is hoisted is pulled in, in order to avoid that loose lopes of sheet lands in the water. However, when the clew corner 9 reaches the first spinnaker guide member 15, the sheets are slacked until the sail is fully hoisted and the leeward sheet 10*a* is pulled in to carry load.

In the present invention, the spinnaker is recovered by reversing the launch procedure: Slacking the halyard 8 attached to the spinnaker head 7 as well as the sheets and simultaneously pulling the tack line 12 attached to the tack corner 11 of the spinnaker 5 until the sail is back in the spinnaker launching and/or recovery system, where it is secured simply by taking the slack out of the halyard 8, the tack line 12 and the sheets 10*a* and 10*b*.

The system thus uses the lines already used for launching, running and recovering conventional asymmetric spinnakers. Thereby the system can be used for launching and/or recovering a spinnaker on a sailboat with the existing spinnaker and without the need for modifying the existing spinnaker.

FIG. 6 shows a side view of a sail boat 1 sailing with an asymmetric spinnaker and a spinnaker launch and/or recovery system releasably attachable to the deck, according to the present invention, where the spinnaker is fully launched for sailing.

The load of the spinnaker 5 is carried by the halyard 8 and the tack line 12, both of which are secured by conventional means used on sailboats, such as winches 19.

Further the load of the spinnaker 5 is carried by the leeward sheet 10*a* which is used for trimming the spinnaker for optimal performance.

During sailing, the load of the tack line 12 is carried by the first 15 and second 16 spinnaker guide members, which are attached to the deck 2*a* by the first set of attachment means 15*a* and the second set of attachment means 17. Thus, the sleeve 14 itself does not carry any load. Further the load of the tack line 12 is carried by the tack line guide means 18 attached to the deck, and a conventional securing means used on sailboats, such as a winch 19 in the cockpit area 21 of the sail boat.

Figure 7:
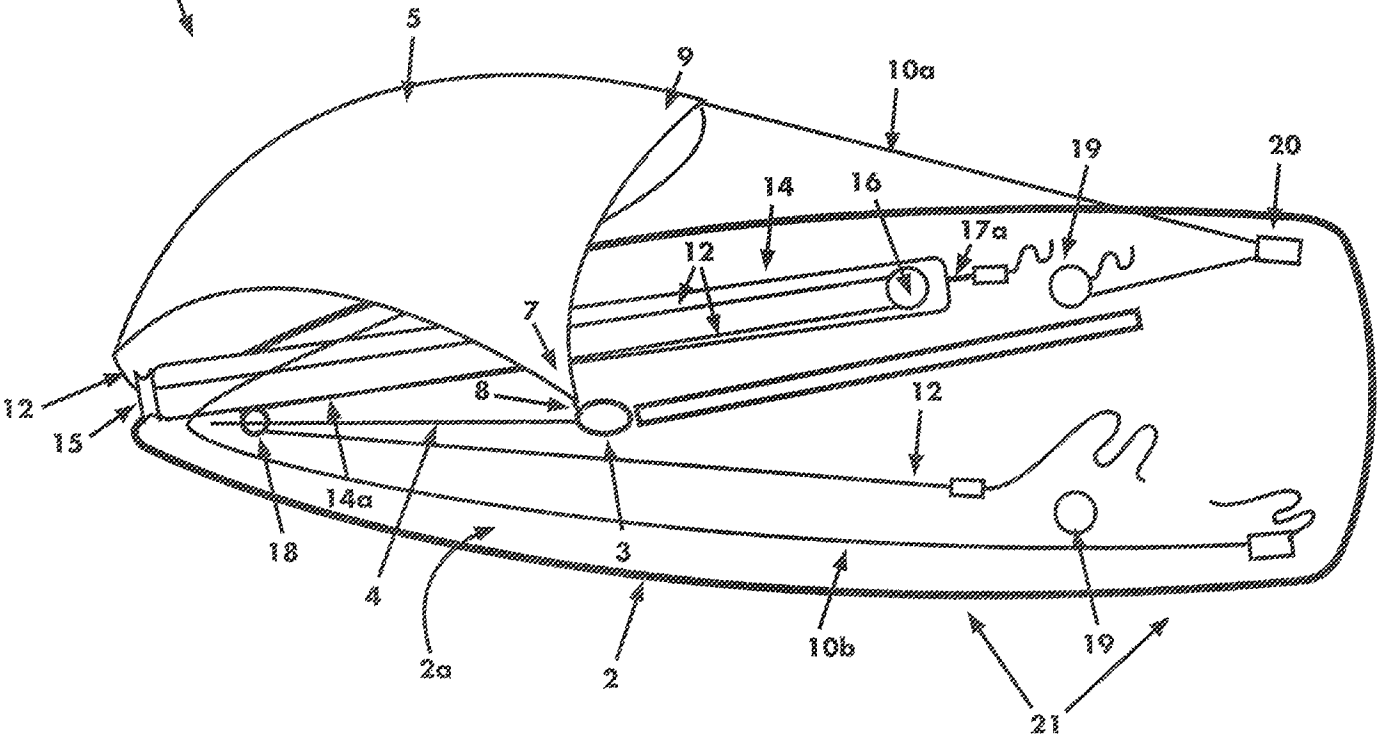
FIG. 7 shows a top view of a sail boat with a spinnaker launching and/or recovery system releasably attachable to the deck, according to the present invention, where the spinnaker is fully launched for sailing.

FIG. 7 shows a top view of a sail boat 1 with a spinnaker launch and/or recovery system reversely attachable to the deck, according to the present invention, where the spinnaker is fully launched for sailing.

The clew corner of the spinnaker 9 is by the leeward active sheet 10*a* and a block 20 on the leeward aft corner of the deck 2*a*, connected to a winch 19 in the cockpit area of the sail boat, for trimming the sail.

The clew corner 9 of the spinnaker 5 is further connected to the windward lazy sheet 10*b*.

The lazy sheet 10*b* is either passing in front of the tack corner 11 of the spinnaker 5 and the tack line 12, or as shown here it passes between the forestay 4 and the tack line 12 and further on to the windward aft corner of the deck 2*a*, where a block 20 guides the lazy sheet to a winch 19. The lazy sheet is not carrying load and it is not secured.

The halyard 8 is via the mast 3 guided to the cockpit area 21 where it is secured, e.g., to a winch 19.

The tack line 12 is, via the first 15 and the second 16 spinnaker guide member, and the tack line guide means 18 guided to the cockpit area 21 of the sail boat, where it is secured, e.g., to a winch 19.

Figure 8:
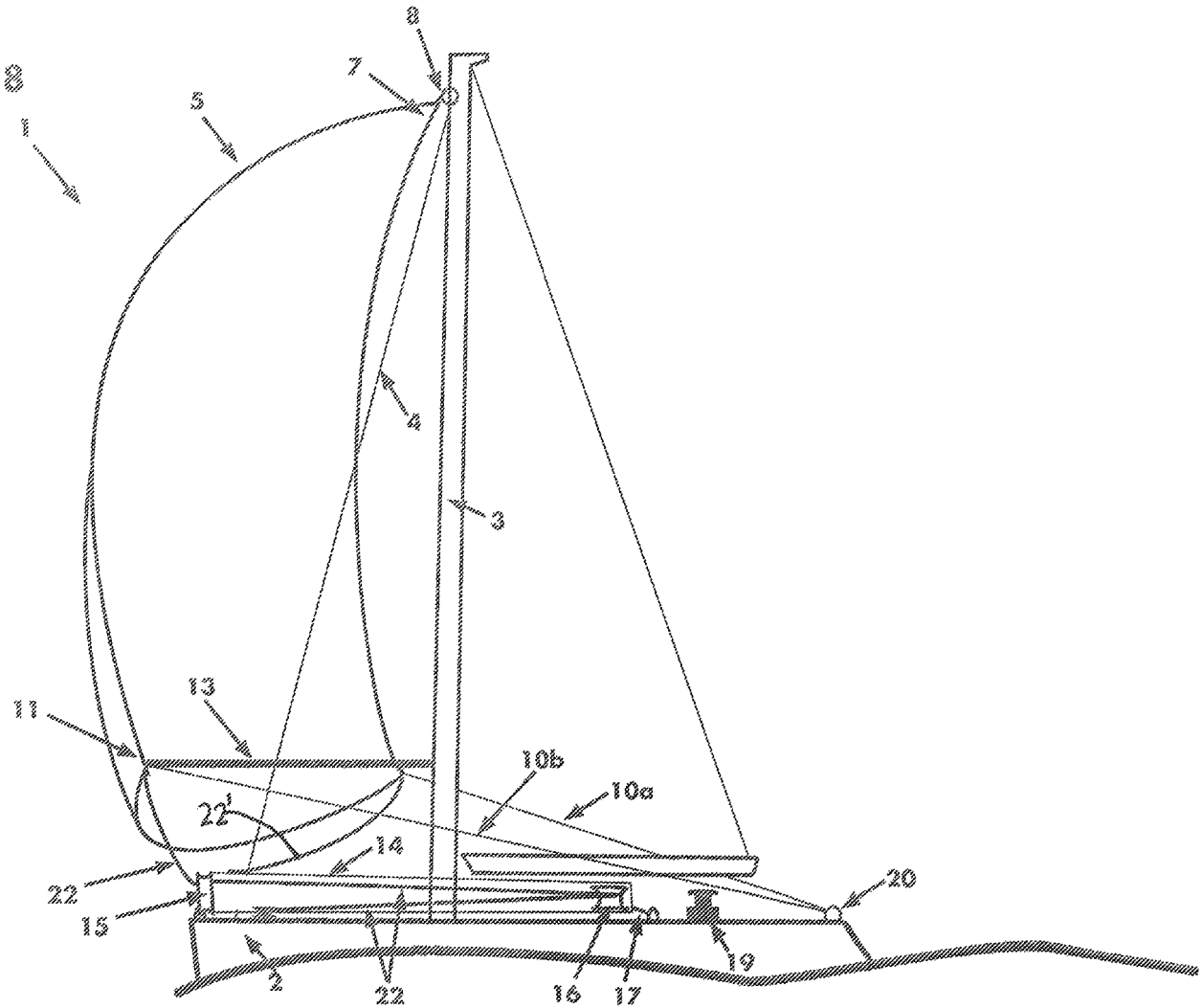
FIG. 8 shows a side view of a sail boat with a spinnaker launching and/or recovery system releasably attachable to the deck, according to the present invention, where a symmetric spinnaker is fully launched for sailing.

FIG. 8 shows a side view of a sail boat 1 with a spinnaker launching and/or recovery system releasably attachable to the deck, according to the present invention, where a symmetric spinnaker is fully launched for sailing.

The system for launching and/or recovering can be used equally well with symmetric spinnakers with only minor adjustments in relation to the procedure described for the asymmetric spinnaker above. The retriever line 22 is attached to the tack corner of the spinnaker 11 or elsewhere low in the spinnaker, and is not carrying load while sailing with the spinnaker.

A second retriever line 22' is mounted to the clew corner or elsewhere low on the spinnaker 11.

When recovering the spinnaker, the retriever line 22 or 22' is pulled and the tack and clew sheets 10*a* and 10*b* as well as the halyard 8 are released.

During gybe of a symmetric spinnaker, the tack corner becomes the clew corner and vice versa. The spinnaker pole 13 is moved from the tack corner 11 to the clew corner during gybe, whereby the clew corner becomes the tack corner and vice versa. The symmetric spinnaker may be lowered using either of the spinnaker recovery lines 22, 22'. In practice, it appears easier to lower the symmetric spinnaker by pulling the recovery line attached to the clew corner. In FIG. 8, the recovery line 22 is attached to the tack corner while recovery line 22' is attached to the clew corner.

It is clear that pulling 1 meter of the recovery line largely must be balanced by slacking the same length of halyard 8 and sheets 10*a* and 10*b*.

Figure 9:
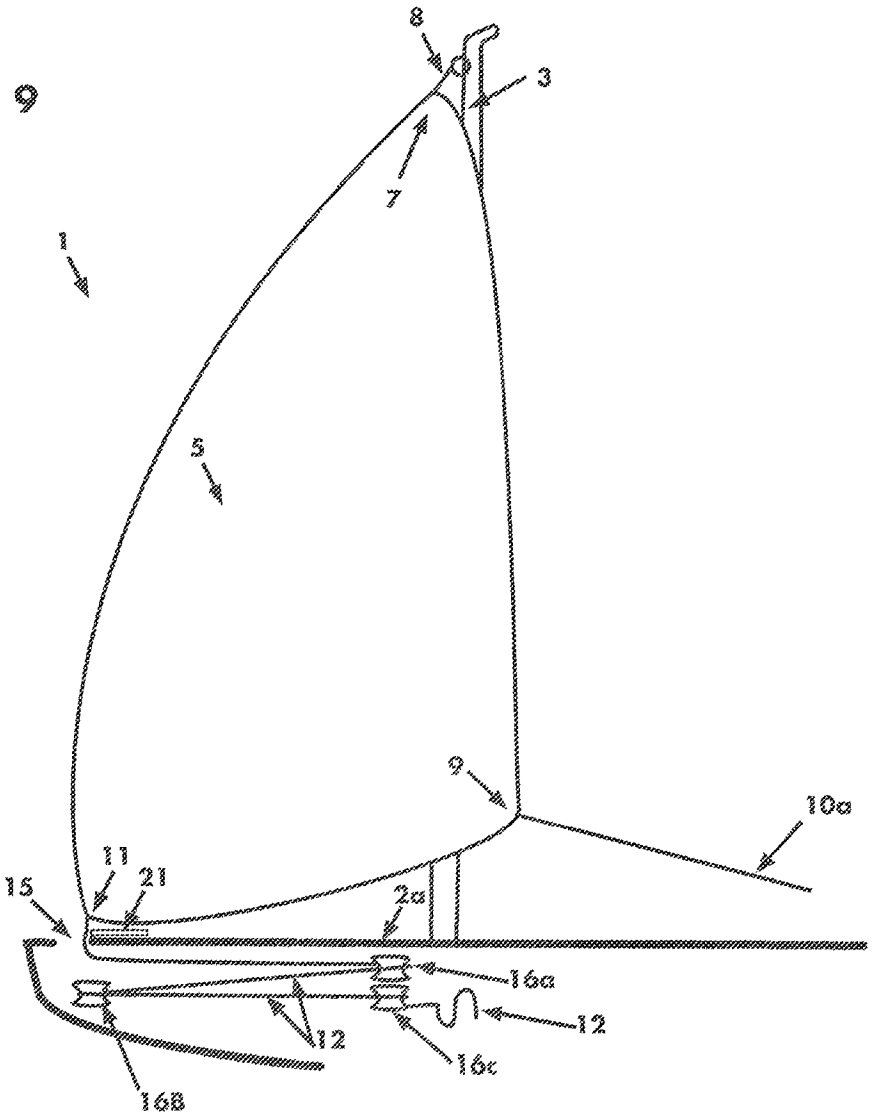
FIG. 9 shows a detailed side view of a sail boat with an asymmetric spinnaker fully launched for sailing and a spinnaker launching and/or recovery system according to the present invention built-in to the hull.
Figure 10:
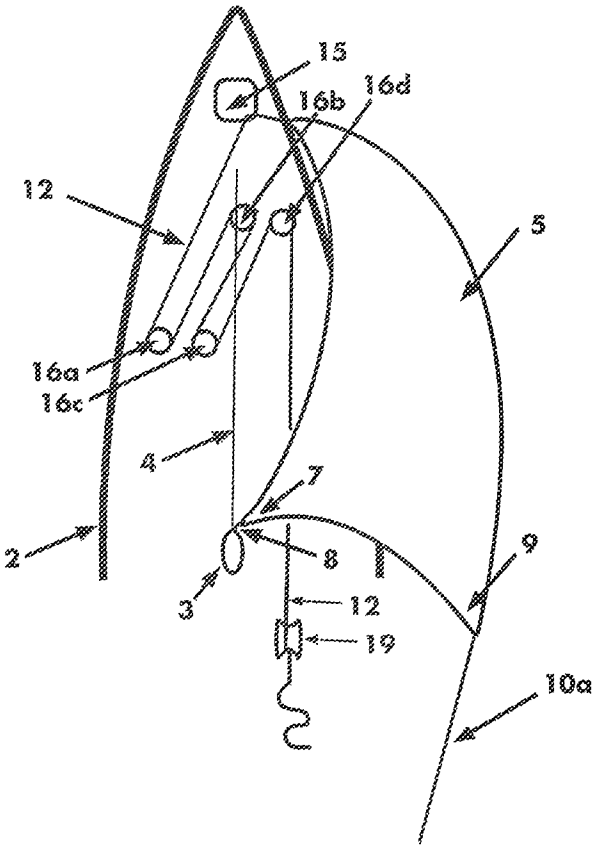
FIG. 10 shows a top view of a sail boat with an asymmetric spinnaker fully launched for sailing and an alternative embodiment of a launching and/or recovery system according to the present invention built-in to the hull.
Figure 18:
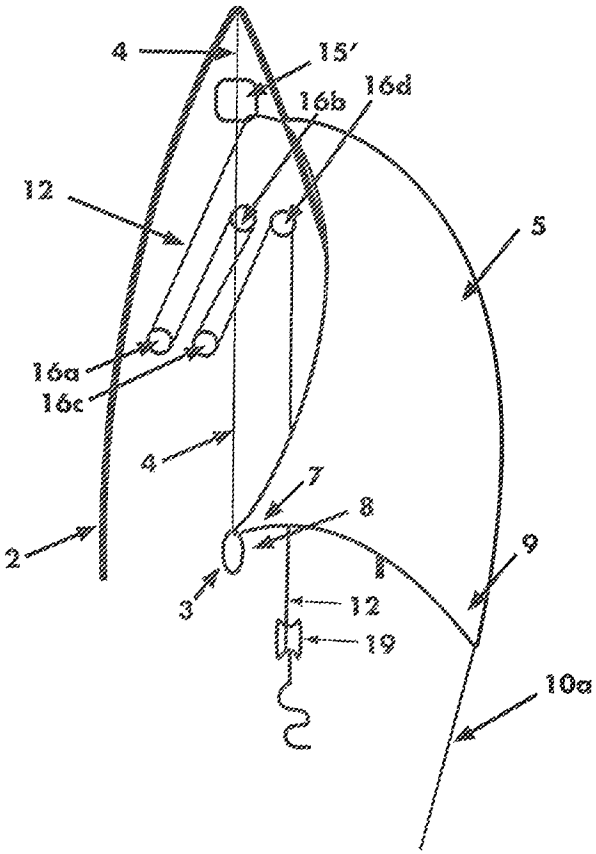
FIG. 18 shows a top view of a sail boat with an asymmetric spinnaker fully launched for sailing and an alternative embodiment of a launching and/or recovery system according to the present invention built in to the hull.

FIGS. 9, 10 and 18 show a detailed side view and at top view of a sail boat 1 with an asymmetric spinnaker fully launched for sailing and variations of a spinnaker launching and/or recovery system according to the present invention built-on to or in to the hull.

The first spinnaker guide member 15' is here embodied as a hatch in the bow end area of the deck 2*a*, preferably in front of the fore stay 4, or behind the fore stay in FIG. 18. At least one second spinnaker guide member 16*a*-16*d* here illustrated by 3 or 4 blocks and/or rollers 16*a*-16*d*, are provided below deck 2*a*. The hatch 15' is preferably provided with a cover 21, which covers the hatch 15', when the spinnaker is stored below deck 2*a*. The spinnaker 5, here illustrated by an asymmetric spinnaker, is set for sailing in FIGS. 9-10 and 18. The tack line 12 is passed through the hatch 15' and passes the second spinnaker guide members 16*a*-16*d*. The first of the blocks/rollers 16*a* is provided below deck towards the cockpit, the second of the blocks/rollers 16*b* is provided below deck towards the bow end, the third of the blocks/rollers 16*c* is provided below deck towards the cockpit etc.

The tack line 12 may be guided to a pulling and slacking means 19 below deck, such as motorized capstans or winches or similar means conventionally used in connection with motorized means for pulling and slacking lines on yachts, e.g., halyards, or sheets, which may be operated by a single person positioned in the safety of the cockpit or the hull.

The spinnaker 5 is recovered as described above, by pulling the tack line 12 and slacking the halyard 8 and the sheets 10*a* and 10*b* whereby the spinnaker 5 is pulled through the hatch 15' and around the one or more second spinnaker guide members 16*a*-16*d* until the head of the spinnaker 7 is pulled through the hatch 15'. Launching the spinnaker is performed by reversing the actions of pulling and slacking as already explained above.

Folding the spinnaker several times using a number of second spinnaker guide means 16*a*, 16*b*, 16*c* on or below deck as shown, enables storage of even a very large or even an extremely large spinnaker 5 in a very limited space, while keeping the spinnaker ready for repeated launch and recovery.

Further the use of motorized means for pulling and slacking lines make it possible for a single person to operate a very large spinnaker on yachts, such as super yachts.

Figure 11:
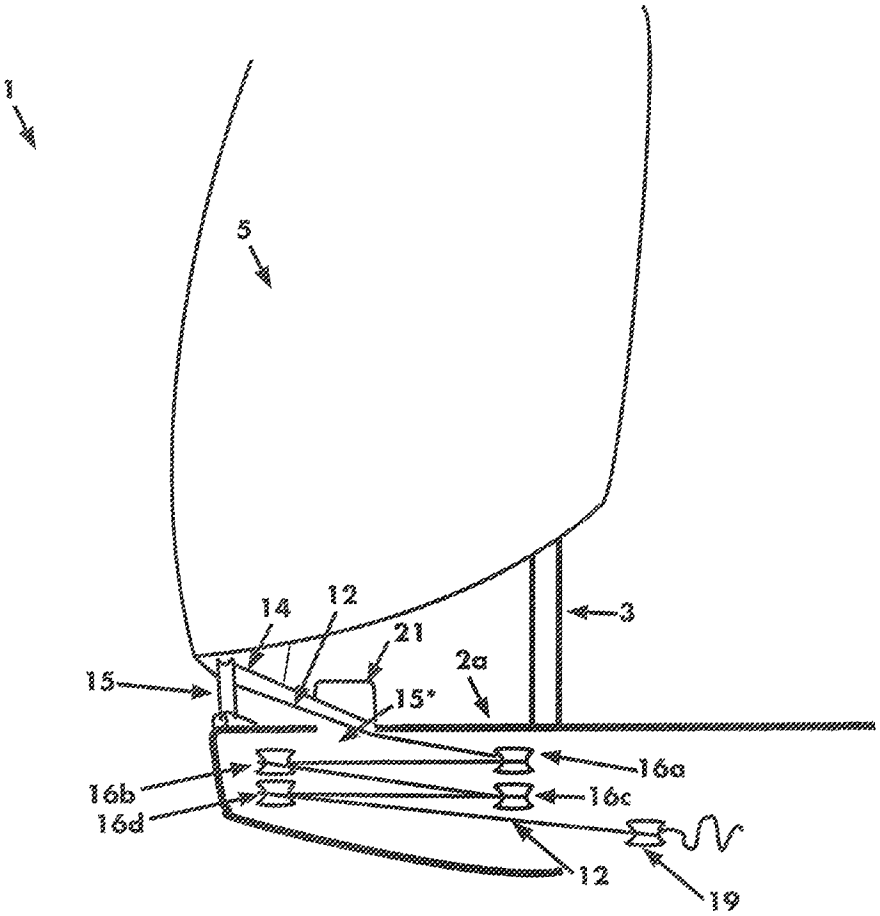
FIG. 11 shows a detailed side view of a sail boat with an asymmetric spinnaker fully launched for sailing and an alternative embodiment of a launching and/or recovery system according to the present invention built-in to the hull.
Figure 12:
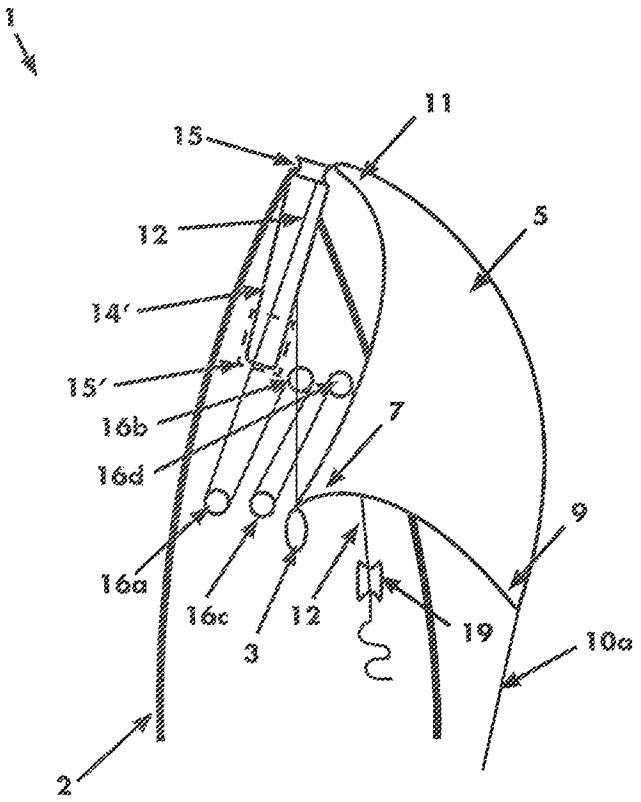
FIG. 12 shows a detailed top view of a sail boat with an asymmetric spinnaker fully launched for sailing and an alternative embodiment of a launching and/or recovery system according to the present invention built into the hull.

FIGS. 11 and 12 show a detailed side view and at top view of a sail boat 1 with an asymmetric spinnaker fully launched for sailing and an alternative embodiment of a launching and/or recovery system according to the present invention built-on to or in to the hull.

A partial sleeve 14' with a first spinnaker guiding member 15 is attached to the hatch 15'. The sleeve 14' and the first spinnaker guiding member 15 are stored below the cover 21 of the hatch 15' when the spinnaker 5 is not in use. The first spinnaker guiding member 15 is attached to the bow or in particular to a bowsprit 6 (not shown in FIG. 11) as described above. Once the first spinnaker guiding member 15 is attached to the bow, the launching and/or recovery of the spinnaker can be performed as described for the built-in version above.

Figure 13:
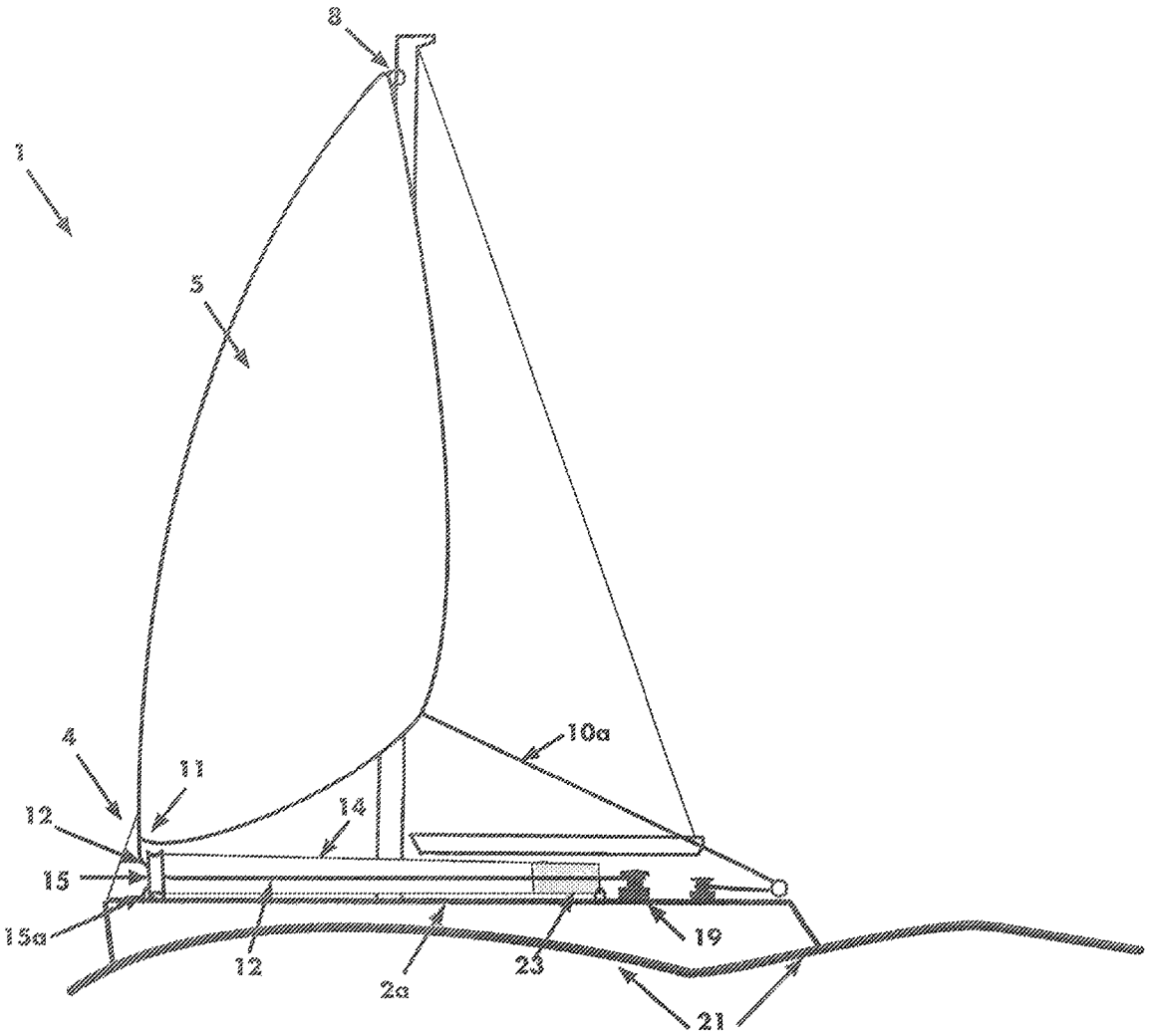
FIG. 13 shows a side view of a sail boat sailing with an asymmetric spinnaker and a variant of the spinnaker launch and/or recovery system, which can be used in smaller boats, reversely attachable to the deck according to the present invention, where the spinnaker is fully launched for sailing.

FIG. 13 shows a side view of a sail boat 1 sailing with an asymmetric spinnaker and a variant of the spinnaker launch and/or recovery system, which can be used in smaller boats, releasably attached to the deck according to the present invention, where the spinnaker is fully launched for sailing.

The variant comprises a first spinnaker guiding member 15 attached to a sleeve 14. The sleeve's 14 other end is attached to a bag 23. The first spinnaker guide member 15 is attached to the deck 2*a* near the bow as shown by a first set of attachment means 15*a* or alternatively it can be attached to a bowsprit 6.

The tack corner 11 of the spinnaker 5 is attached to the tack line 12, which is drawn through the first spinnaker guide member 15, the sleeve 14 and the bag 23 to a winch 19 or other means for pulling, slacking and/or securing lines on boats in the cockpit area 21 of the boat.

The bag 23 is attached to the deck 2*a* in front of the winch 19.

The load of the tack line 12 is carried by the first spinnaker guide member 15 and the winch 19. or, for sailing, the load carried by the first spinnaker guide member 15 may be taken over by a second tack line 12*a* bringing the tack corner 11 of the spinnaker forward to the bow or to the bow sprit. A second tack line 12*a* bringing the tack corner of the spinnaker forward to the bow or to the bow sprit 6 maybe used when the first spinnaker guide member is placed on the foredeck behind the forestay 4 as shown, or a less advanced position as such.

Taking the tack corner of the spinnaker forward to an advanced position, away from the first spinnaker guide member placed in a less advanced position, increases the efficacy of the spinnaker, since it escapes the turbulence created by the other sails of the boat.

The variant of the spinnaker launch and/or recovery system may be built onto or into the hull of the boat.

Figure 13A:
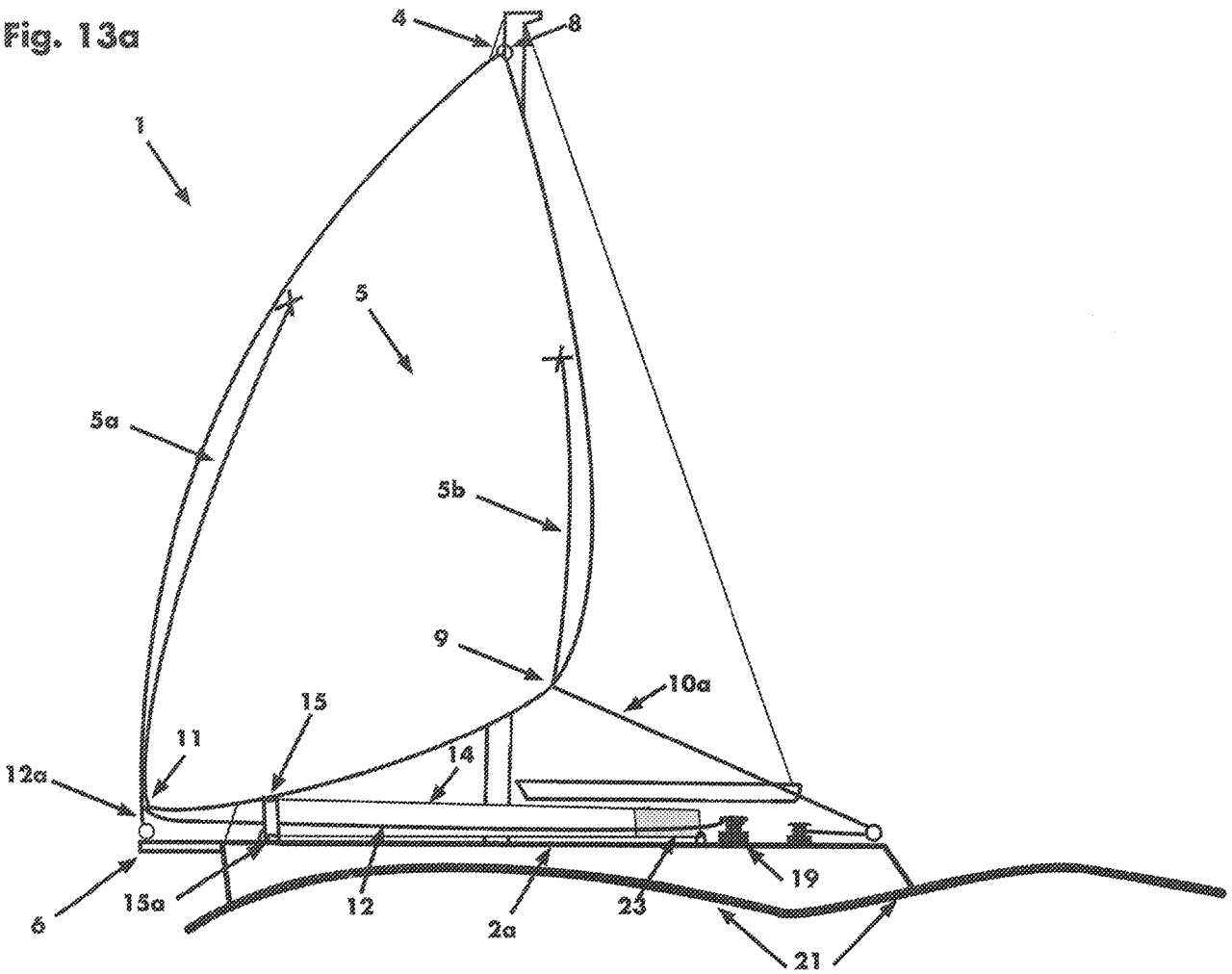
FIG. 13*a* shows a side view of a sail boat sailing with an asymmetric spinnaker and a variant of the spinnaker launch and/or recovery system, which can be used in smaller boats, reversely attachable to the deck according to the present invention, where the spinnaker is fully launched for sailing.

FIG. 13*a* shows a side view of a sail boat 1 sailing with an asymmetric spinnaker and a variant of the spinnaker launch and/or recovery system, which can be used in smaller boats, releasably attached to the deck according to the present invention, where the spinnaker is fully launched for sailing.

The variant comprises a first spinnaker guiding member 15 attached to a sleeve 14. The sleeve's 14 other end is attached to a bag 23. The first spinnaker guide member 15 is attached to the deck 2*a* near the bow as shown by a first set of attachment means 15*a*

The tack corner 11 of the spinnaker 5 is attached to the tack line 12, which is drawn through the first spinnaker guide member 15, the sleeve 14 and the bag 23 to a winch 19 or other means for pulling, slacking and/or securing lines on boats in the cockpit area 21 of the boat.

The tack line 12 is preferably not carrying load.

The bag 23 is attached to the deck 2*a* in front of the winch 19.

The load of the tack corner of the sail is not carried by the first spinnaker guide member 15 and the winch 19. For sailing, the load is carried by a second tack line 12*a* bringing the tack corner 11 of the spinnaker forward to the bow or to the bow sprit 6, as seen in FIG. 13*a*. A second tack line 12*a* attaches the tack corner 11 of the spinnaker 5 to the bow or to the bow sprit 6. The second tack line 12*a* is used when the first spinnaker guide member 15 is placed on the foredeck behind the forestay 4, or a less advanced position as such.

By attaching the tack corner 11 of the spinnaker in an advanced position, in front of the first spinnaker guide member 15 placed in a less advanced position the efficacy of the spinnaker increases, since the spinnaker escapes the turbulence created by the other sails of the boat.

A helper line 5*a* is attached a "sleeves length" up the leading edge (tack of an asymmetric spinnaker) of the spinnaker. Similarly, a second helper line 5*b* may be attached to the rear edge (clew) of the spinnaker.

The leading helper line 5*a* is preferably also attached to the lower corner on the leading edge of the spinnaker, i.e., the tack corner 11 in FIG. 13*a*. The upper end of the leading helper line 5*a* is attached near the leading edge of the spinnaker 5. Similarly, the rear helper line 5*b* is preferably also attached to the clew corner 9 and along the rear edge of the spinnaker 5 or if a retrieval line is attached to the lower luff, a "luff" helper line may be placed in the sail from the lower luff pointing up against the top of the sail.

The attachment means are conventional attachment means for attaching lines to a sail and may, e.g., comprise a strap, a ring member, or similar means attached to the lower corner area of the spinnaker and at approximately one sleeves length up the spinnaker near the edge of the spinnaker. The helper line is, e.g., tied to the strap or ring member or attached by hooks. Alternatively, ends of the helper line(s) are permanently attached to the spinnaker, e.g., by attaching a patch over the end of the helper line 5*a*, 5*b* or similar means conventionally used in sail making.

Pulling in the additional (set of) helper line or lines 5*a*,5*b* as the spinnaker is lowered, will bring another sleeves length of the spinnaker into the sleeve 14.

If needed, e.g., when using large spinnakers, one or more additional upper helper lines or sets of helper lines (not shown) may be attached above the first set of helper lines with the top end of the helper line at a distance corresponding to approximately a sleeves length above the lower (set of) helper lines 5*a*, 5*b*.

A similar system of helper lines as shown on FIG. 13*a* may be used when a symmetric spinnaker is used with this simplified system.

Figure 14A:
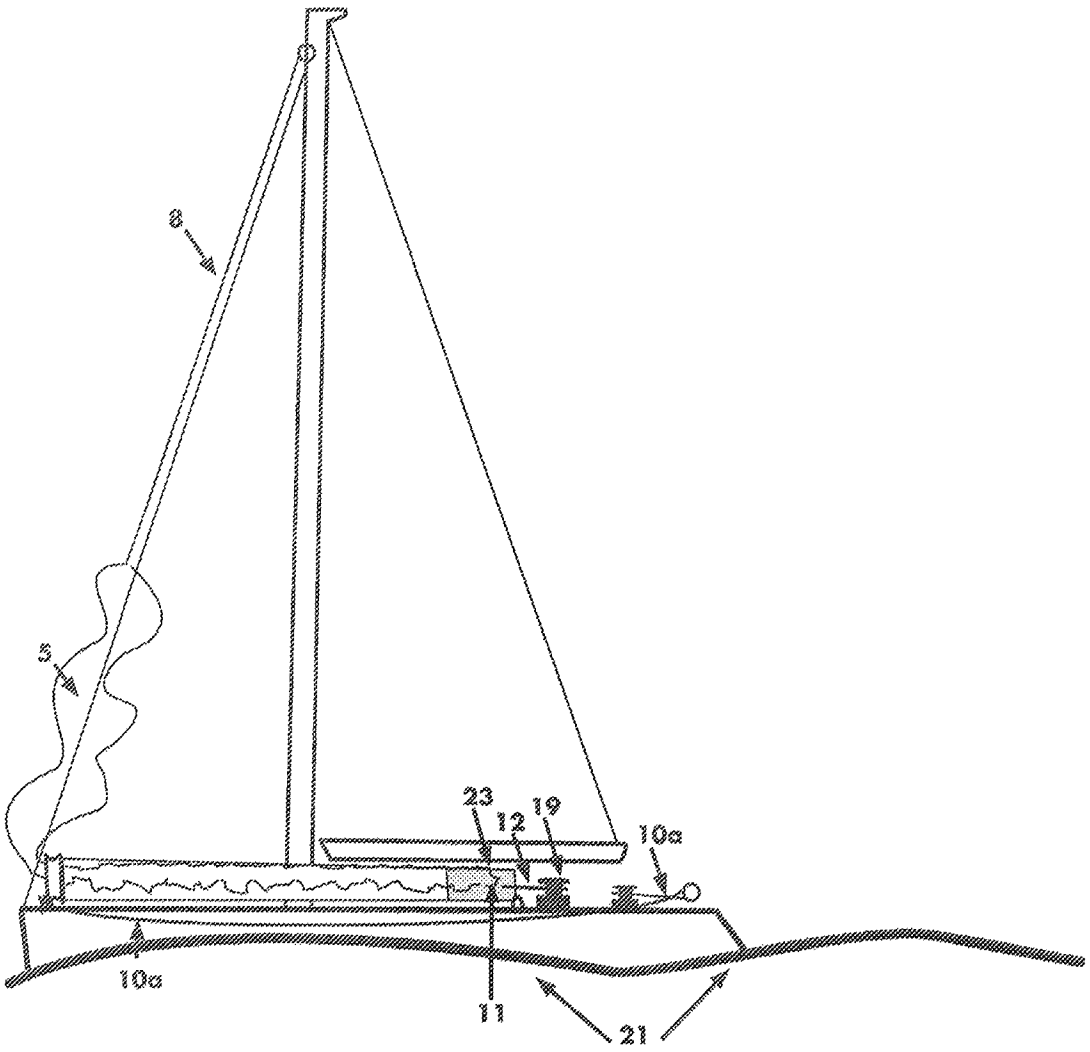
FIGS. 14 *a* & 14*b* show a side view of a sail boat sailing with an asymmetric spinnaker and a variant of the spinnaker launching and/or recovery system, which can be used in smaller boats, releasably attachable to the deck according to the present invention, where the spinnaker is partly and fully recovered, respectively.

FIG. 14*a* shows a side view of a sail boat 1 sailing with an asymmetric spinnaker 5 and a variant of the spinnaker launch and/or recovery system, which can be used in smaller boats, releasably attachable to the deck 2*a* according to the present invention, where the spinnaker 5 is partly recovered. The first spinnaker guiding ring member 15 may be attached to the deck or the bowsprit 6 in front of the fore stay (not shown). Alternatively, first spinnaker recovery ring member 15 may be attached to the deck or the bowsprit or behind the fore stay 4 (as shown in FIGS. 13 & 14), to allow the spinnaker to be raised and/or recovered from behind the fore stay 4.

When recovering the spinnaker 5, the tack line 12 is pulled in, simultaneously the halyard 8, the optional second tack line 12*a* and the sheets 10*a* and 10*b* are slacked. When the tack corner 11 of the spinnaker 5 reaches the bag 23, the tack line 12 (or either of the tack or clew recovery lines 22, 22', see FIG. 8, in case a symmetric spinnaker is in use) is secured, e.g., to the winch 19, and the rest of the spinnaker is pulled into the spinnaker launch and/or recovery system by hand, and secured in the bag 23 (see FIG. 14*b*). Pulling the remaining part of the spinnaker 5 is done either by grasping the fabric of the spinnaker 5 through the open bag 23, while standing or sitting near the bag 23 in the area of the cockpit 21, or by pulling in the lower helper line 5*a* and possibly the following upper helper line or lines by hand, by hand using a winch or by pulling and slacking means, such as motorized capstans or winches or similar means conventionally used in connection with motorized means for pulling and slacking lines on yachts, e.g., halyards, or sheets, which may be operated by a single person in the safety of the cockpit or the hull. The spinnaker 5 is preferably removed from the sleeve 14 when not in use, e.g., by packing the spinnaker into the bag 23. This is done for security reasons, especially during hard wind or similar difficult sailing conditions.

Figure 14B:
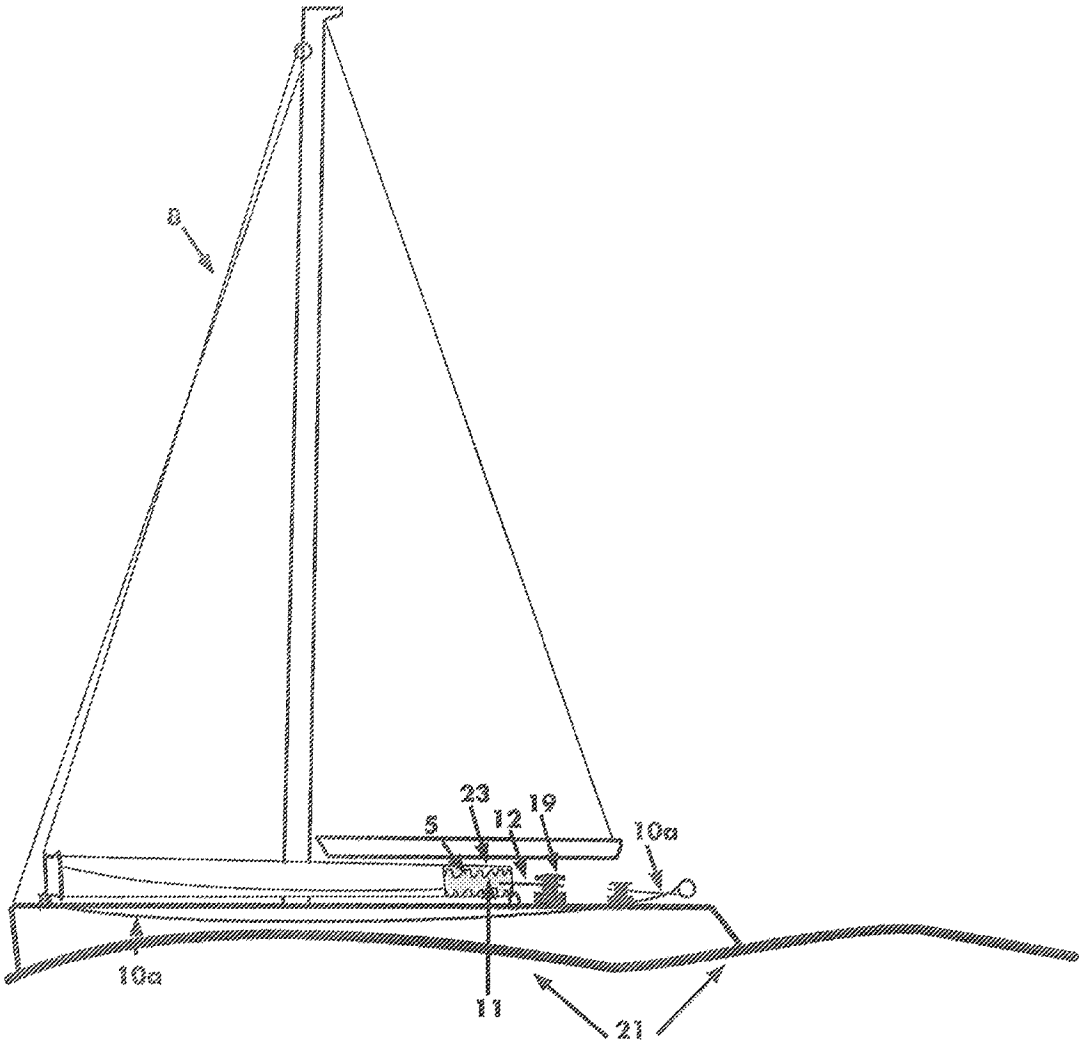

FIG. 14*b* shows a side view of a sail boat 1 sailing with an asymmetric spinnaker 5 and a variant of the spinnaker launch and/or recovery system, releasably attachable to the deck 2*a* according to the present invention, where the spinnaker is fully recovered. The spinnaker 5 rests in the cockpit end of the sleeve 14, here shown as a bag 23. The spinnaker 5 is secured in the bag by the tackline 12 and the helper lines 5*a*. The second tackline 12*a* the halyard 8 and the sheets 10*a*, 10*b* are resting. The spinnaker 5 is ready to be launched again.

The spinnaker 5 is launched by reversing the procedure.

Figure 15:
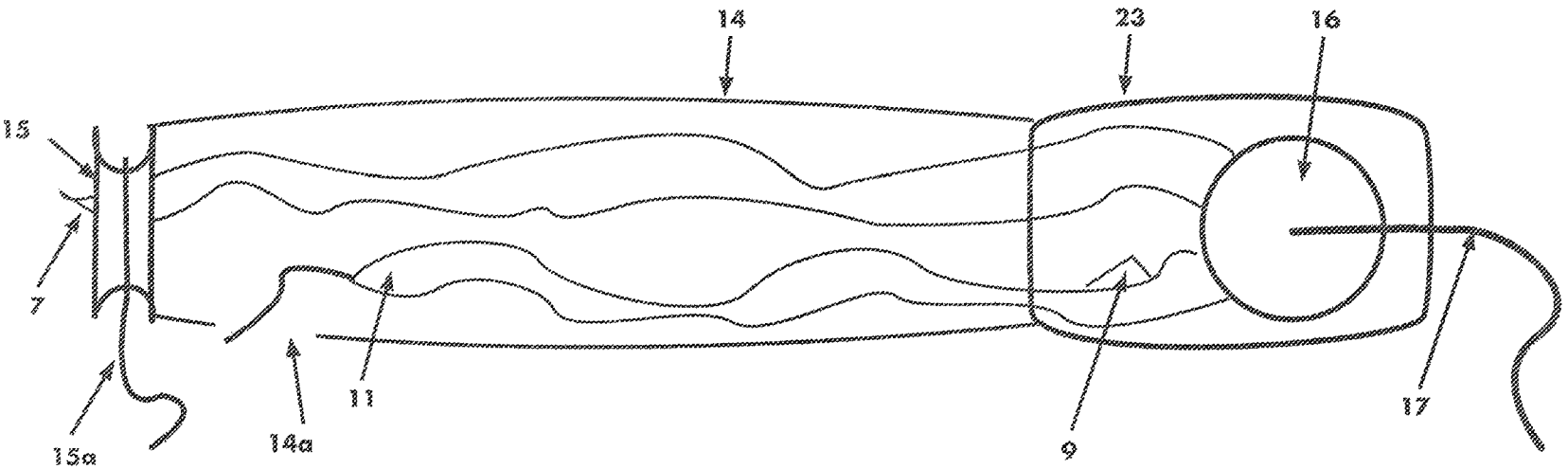
FIG. 15 shows an embodiment of the releasably attachable spinnaker launching and/or recovery system detached from the deck.

FIG. 15 shows an embodiment of the spinnaker launch and/or recovery system as shown in FIGS. 3-8, which is detached from the deck.

The first spinnaker guide member 15 is attached to the sleeve 14. In the rear end of the sleeve a bag 23 is holding the second spinnaker guide member 16.

The line of the first set of attachment means 15*a* and the line of the second attachment means 17 are loose.

The head 7 of the spinnaker 5 is resting in the aperture of the first spinnaker guide member 15. The clew corner 9 of the spinnaker 5 is resting in the spinnaker launch and/or recovery system near the second spinnaker guide member 16. The tack corner 11 of the spinnaker 5 is resting in the sleeve 14 near the tack line aperture 14*a*

Figure 16:
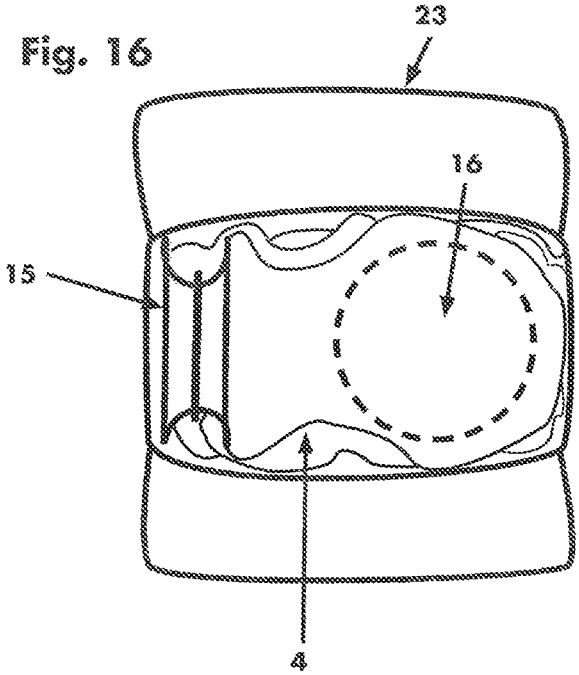
FIG. 16 shows an embodiment of the reversely attachable spinnaker launching and/or recovery system detached from the deck, and folded in to the bag.

FIG. 16 shows the embodiment of the spinnaker launch and/or recovery system as shown in FIGS. 3-8, which is detached from the deck, and the spinnaker launch and/or recovery system is packed into the bag 23.

For storing the detached spinnaker launch and/or recovery system is folded into the bag 23. The bag 23 is designed to hold the spinnaker launch and/or recovery system as it is shown in FIG. 15.

Figure 17:
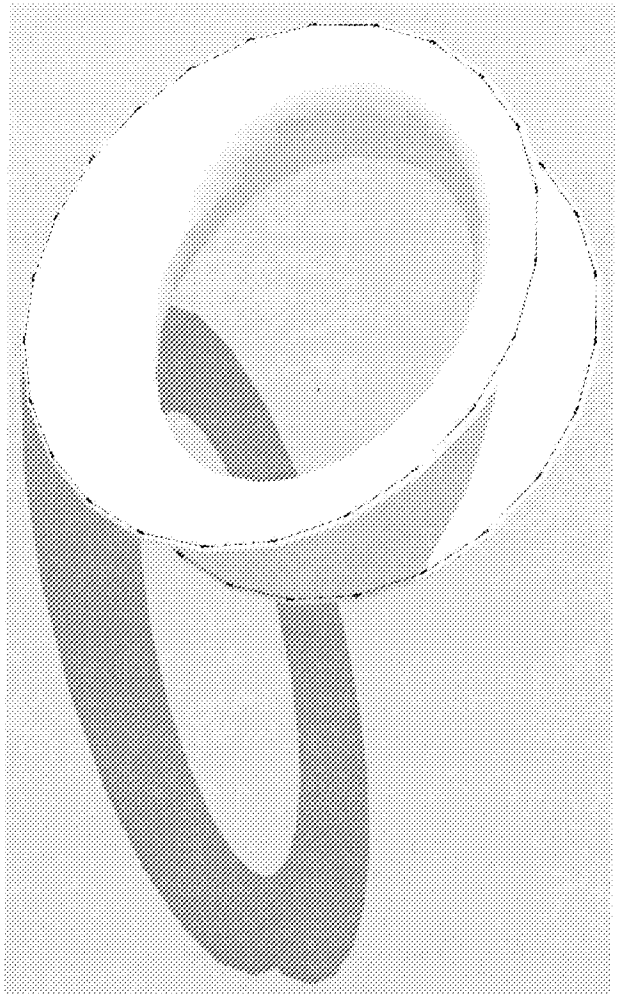
FIG. 17 shows an embodiment of the first spinnaker guide member.

FIG. 17 shows an embodiment of the first spinnaker guide member 15.

The first spinnaker guide member 15 may be ring suitable for easy passage of the tack line 12 and the spinnaker 5 through the central aperture. The ring may be grooved on the outside. The groove may anchor the first set of attachment means 15*a*.

The ring 15 will carry the load of the tack line 12, which is considerable. The ring 15 may be produced in a light and strong material such as a carbon fiber reinforced resin material or metals, such as steel, or a combination of materials, e.g., composites.

FIG. 18 shows a detailed top view of a sail boat 1 with an asymmetric spinnaker fully launched for sailing and a variation of a spinnaker launching and/or recovery system according to the present invention built-on to or in to the hull.

The first spinnaker guide member 15 is here embodied as a hatch in the bow end area of the deck 2*a*, behind the fore stay. At least one second spinnaker guide member 16*a*-16*d* here illustrated by 4 blocks and/or rollers 16*a*-16*d*, are provided below deck 2*a*. The hatch 15' is preferably provided with a cover 21, which covers the hatch 15', when the spinnaker is stored below deck 2*a*. The spinnaker 5, here illustrated by an asymmetric spinnaker, is set for sailing. The tack line 12 is passed through the hatch 15' and passes the second spinnaker guide members 16*a*-16*d*. The first of the blocks/rollers 16*a* is provided below deck towards the cockpit, the second of the blocks/rollers 16*b* is provided below deck towards the bow end, the third of the blocks/rollers 16*c* is provided below deck towards the cockpit etc.

The tack line 12 may be guided to a pulling and slacking means 19 below deck, such as motorized capstans or winches or similar means conventionally used in connection with motorized means for pulling and slacking lines on yachts, e.g., halyards, or sheets, which may be operated by a single person positioned in the safety of the cockpit or the hull.

The spinnaker 5 is recovered as described above, by pulling the tack line 12 and slacking the halyard 8 and the sheets 10*a* and 10*b* whereby the spinnaker 5 is pulled through the hatch 15' and around the one or more second spinnaker guide members 16*a*-16*d* until the head of the spinnaker 7 is pulled through the hatch 15'. Launching the spinnaker is performed by reversing the actions of pulling and slacking as already explained above.

Folding the spinnaker several times using a number of second spinnaker guide means 16*a*, 16*b*, 16*c* on or below deck as shown, enables storage of even a very large or even an extremely large spinnaker 5 in a very limited space, while keeping the spinnaker ready for repeated launch and recovery.

Further, the use of motorized means for pulling and slacking lines makes it possible for a single person to operate a very large spinnaker on yachts such as super yachts.

What is claimed is:

1. A spinnaker launching and/or recovering system for launching and/or recovering a spinnaker on a sailboat, comprising at least one hull with a deck, a bow and at least one mast extending upright from the deck of the sailboat, wherein the spinnaker setting and/or recovering system comprises:

a spinnaker, comprising a halyard line attached to a top corner of the spinnaker, a tack line/sheet and a clew line/sheet attached to respective tack and clew corners of the spinnaker, a first spinnaker guiding member, which comprises a ring member and/or a hatch, and which is releasably attachable to the bow in front or behind the fore stay, a bowsprit or integrated onto or into the deck near the bow, wherein said first spinnaker guiding member comprises an opening for guiding a line attached to a tack corner of the spinnaker and the spinnaker itself during setting and/or recovering thereof, and wherein the spinnaker being recoverable from the tack corner by slacking the halyard line attached to the spinnaker as well as the sheets and simultaneously pulling a line attached to the tack corner of the spinnaker until the spinnaker is recovered in the spinnaker launching and/or recovery system.

2. A method for launching and/or recovering a spinnaker on a sailboat having a hull with, a cockpit, a deck, a bow and at least one mast extending upright from the deck, the spinnaker having a head at a top to which a halyard is attached for raising the head to the top of the mast, said spinnaker also having a tack and a clew corner at a lower end, a tack line/sheet being attached to the tack and a clew line/sheet being attached to the clew, the method comprising launching the spinnaker by pulling the halyard attached to the spinnaker's head and the slacked sheets to raise the spinnaker's head and secure it to the top of the mast and simultaneously slacking the line or lines attached to the tack corner of the spinnaker until the spinnaker is launched out of the spinnaker and/or recovery system, and recovering the spinnaker by slacking the halyard attached to the spinnaker head as well as the sheets and simultaneously pulling the tack corner of the spinnaker until the spinnaker is recovered in the spinnaker launching and/or recovery system.

3. A spinnaker launching and/or recovering system according to claim 1, wherein the spinnaker launching and/or recovering system further comprises at least one second spinnaker guiding member, releasably attachable to the deck, below deck or integrated onto or into the hull, said second spinnaker guide member being positionable closer to the cockpit than the first spinnaker guide member, and where said second spinnaker guide member is intended for guiding the tack line and at least a part of the spinnaker around said first spinnaker after passing through the first spinnaker guiding member.

4. A spinnaker launching and/or recovering system according to claim 1, wherein the spinnaker is asymmetric and comprises a halyard line attached to a top corner of the spinnaker, a tack line and a clew line attached to respective tack and clew corners of the spinnaker, wherein the spinnaker is recovered by slacking the halyard attached to the spinnaker head as well as: the tack line attached to the tack corner of the asymmetric spinnaker until the spinnaker is recovered in the spinnaker launching and/or recovery system.

5. A spinnaker launching and/or recovering system according to claim 1, wherein the spinnaker is symmetric and comprises a halyard line attached to the top corner and a guy line and a sheet as well as a retriever line attached to the respective lower tack and clew corners thereof, Wherein the spinnaker is recovered by slacking the halyard attached to the spinnaker head as well as the sheets attached to the tack and clew corners and simultaneously pulling the retriever line attached to the tack corner of the symmetric spinnaker until the spinnaker is recovered in the spinnaker launching and/or recovery system.

6. A method according to claim 2, wherein the spinnaker is asymmetric and where the asymmetric spinnaker is raised or lowered by using the halyard and the tack line attached to the tack corner.

7. A method according to claim 2, wherein the spinnaker is symmetric and is launched by pulling the halyard attached to the spinnaker's head and the slacked sheets to raise the spinnaker's head and secure it to the top of the mast and simultaneously slacking the retriever line attached to the tack corner of the spinnaker until the symmetrical spinnaker is launched out of the spinnaker and/or recovery system, and recovering the symmetrical spinnaker by slacking the halyard attached to the symmetric spinnaker's head as well as the sheets and simultaneously pulling the retriever line attached to the tack corner of the symmetric spinnaker until the spinnaker is recovered in the spinnaker launching and/or recovery system.

8. A spinnaker launching and/or recovering system according to claim 1, wherein the spinnaker comprises a second tack line attached to the tack corner of the spinnaker.

9. A spinnaker launching and/or recovering system according to claim 1, further comprising one of a roller wheel, a capstan, a ring member, and a carabineer for guiding at least one of the tack line and the spinnaker recovery line from the second spinnaker guide member towards the bow and, via at least one of the tack line and the spinnaker recovery line guiding means back towards the cockpit in an aft area of the sailboat.

10. A spinnaker launching and/or recovering system according to claim 1, wherein the first spinnaker guide member is connected to a sleeve.

11. A spinnaker launching and/or recovering system according to claim 1, wherein the first spinnaker guide member comprises a ring member which is releasably attachable to the deck, the bow or a bowsprit, and wherein the second spinnaker guide member comprises one of a block, a capstan and a roller which is releasably attachable to the deck.

12. A spinnaker launching and/or recovering system according to claim 1, wherein the first spinnaker guide member comprises a hatch in the deck in the vicinity of the bow, in front of or behind a fore stay, and the one or more spinnaker guide members, which comprise block, capstan or roller means, are arranged below deck.

13. A spinnaker launch and/or recovering system according to claim 1, wherein a sleeve with a first spinnaker guide member at the first end is attached to the hatch at the second end for guiding the spinnaker through the hatch and below deck.

14. A spinnaker launching and/or recovering system according to claim 1, wherein one or more helper lines are attached with a top end thereof at approximately a sleeve length up from the leading edge and/or the rear edge of the spinnaker from a lower luff pointing against the top of the sail.

15. A method for launching and/or recovering a spinnaker according to claim 2, further comprising storing the spinnaker in a spinnaker launching and/or recovery means after being recovered and until being launched again.

16. A method for launching and/or recovering a spinnaker according to claim 2, further comprising launching the spinnaker by pulling the spinnaker out of the spinnaker launching and/or recovering system by slacking the tack line and simultaneously pulling the halyard to raise the spinnaker head, and securing the spinnaker head to the top of the mast and pulling at least one sheet to set the spinnaker.

17. A method for launching and/or recovering a spinnaker according to claim 2, further comprising guiding a lower part of the spinnaker through the first spinnaker guide means by pulling at least the tack line and subsequently as the tack corner or the clew corner reaches the cockpit end of the sleeve, recovering a next part of the spinnaker into the sleeve by pulling at one or more helper lines attached with the top end thereof at a sleeve length up the leading edge and/or the rear edge of the spinnaker or elsewhere on the asymmetrical or symmetrical spinnaker.

18. A method for launching and/or recovering a spinnaker according to claim 2, wherein one or more additional helper lines are attached above a first helper line or a first set of helper lines.

* * * * *